US007300264B2

(12) United States Patent
Souza

(10) Patent No.: US 7,300,264 B2
(45) Date of Patent: Nov. 27, 2007

(54) PERISTALTIC PUMP

(75) Inventor: Timothy M. Souza, Lebanon, OR (US)

(73) Assignee: Hewlett-Packard Development, L.P., Houston, TX (US)

( * ) Notice: Subject to any disclaimer, the term of this patent is extended or adjusted under 35 U.S.C. 154(b) by 634 days.

(21) Appl. No.: 10/657,425

(22) Filed: Sep. 8, 2003

(65) Prior Publication Data

US 2005/0053502 A1 Mar. 10, 2005

(51) Int. Cl.
*F04B 43/12* (2006.01)

(52) U.S. Cl. ..... 417/477.11

(58) Field of Classification Search ..... 417/476, 417/477.11

See application file for complete search history.

(56) References Cited

U.S. PATENT DOCUMENTS

| | | | | |
|---|---|---|---|---|
| 3,597,124 A | | 8/1971 | Adams | |
| 3,723,030 A | | 3/1973 | Gelfand | |
| 3,739,717 A | | 6/1973 | Brown et al. | |
| 3,791,777 A | | 2/1974 | Papoff et al. | |
| 3,832,096 A | | 8/1974 | Gelfand | |
| 4,025,241 A | * | 5/1977 | Clemens | 417/477.11 |
| 4,189,286 A | | 2/1980 | Murry et al. | |
| 4,210,138 A | | 7/1980 | Jess et al. | |
| 4,218,197 A | | 8/1980 | Meyer et al. | |
| 4,519,754 A | | 5/1985 | Minick | |
| 4,673,334 A | * | 6/1987 | Allington et al. | 417/477.11 |
| 4,886,431 A | | 12/1989 | Soderquist et al. | |
| 4,925,376 A | | 5/1990 | Kahler | |
| 5,033,943 A | | 7/1991 | Durrum et al. | |
| 5,082,429 A | | 1/1992 | Soderquist et al. | |
| 5,349,825 A | | 9/1994 | Duke et al. | |
| 5,447,417 A | | 9/1995 | Kuhl et al. | |
| 5,549,461 A | | 8/1996 | Newland | |
| 5,746,585 A | * | 5/1998 | McDunn et al. | 417/477.11 |
| 6,551,080 B2 | | 4/2003 | Andersen et al. | |
| 6,557,987 B1 | * | 5/2003 | Shibata et al. | 347/84 |

FOREIGN PATENT DOCUMENTS

| | | |
|---|---|---|
| DE | 31 08 029 A1 | 9/1982 |
| DE | 195 02 032 A1 | 7/1995 |
| EP | 0 786 596 A1 | 7/1997 |
| EP | 1 188 566 A1 | 3/2001 |

OTHER PUBLICATIONS

Translation of Leilde (EP 0 786 596).*
German Office Action for DE 102004031137.4-15, 5 pages.

* cited by examiner

*Primary Examiner*—Michael Koczo, Jr.

(57) ABSTRACT

A peristaltic pump includes occluding surfaces rotatably supported by a support, an occlusion having an occlusion surface and a drive system configured to rotate occluding surfaces about a common axis. At least one of the support and the occlusion is movable towards the other of the support and the occlusion. The drive system is coupled to at least one of the support and the occlusion so as to move at least one of the support and the first occlusion.

39 Claims, 15 Drawing Sheets

PERISTALTIC PUMP

BACKGROUND OF THE INVENTION

Peristaltic pumps are used in a wide variety of applications for pumping fluid. Peristaltic pumps typically include a roller assembly having a plurality of rollers which are rotated against a fluid-containing tube to successfully and progressively collapse or compress the tube against an occlusion to move fluid along the tube in the direction that the roller assembly is rotated. In many peristaltic pumps, the rollers are left in engagement with the tube when the pump is not in use. This results in a permanent set in the tube and the inconsistent pumping of fluid.

DETAILED DESCRIPTION OF THE EXAMPLE EMBODIMENTS

Figure 1:
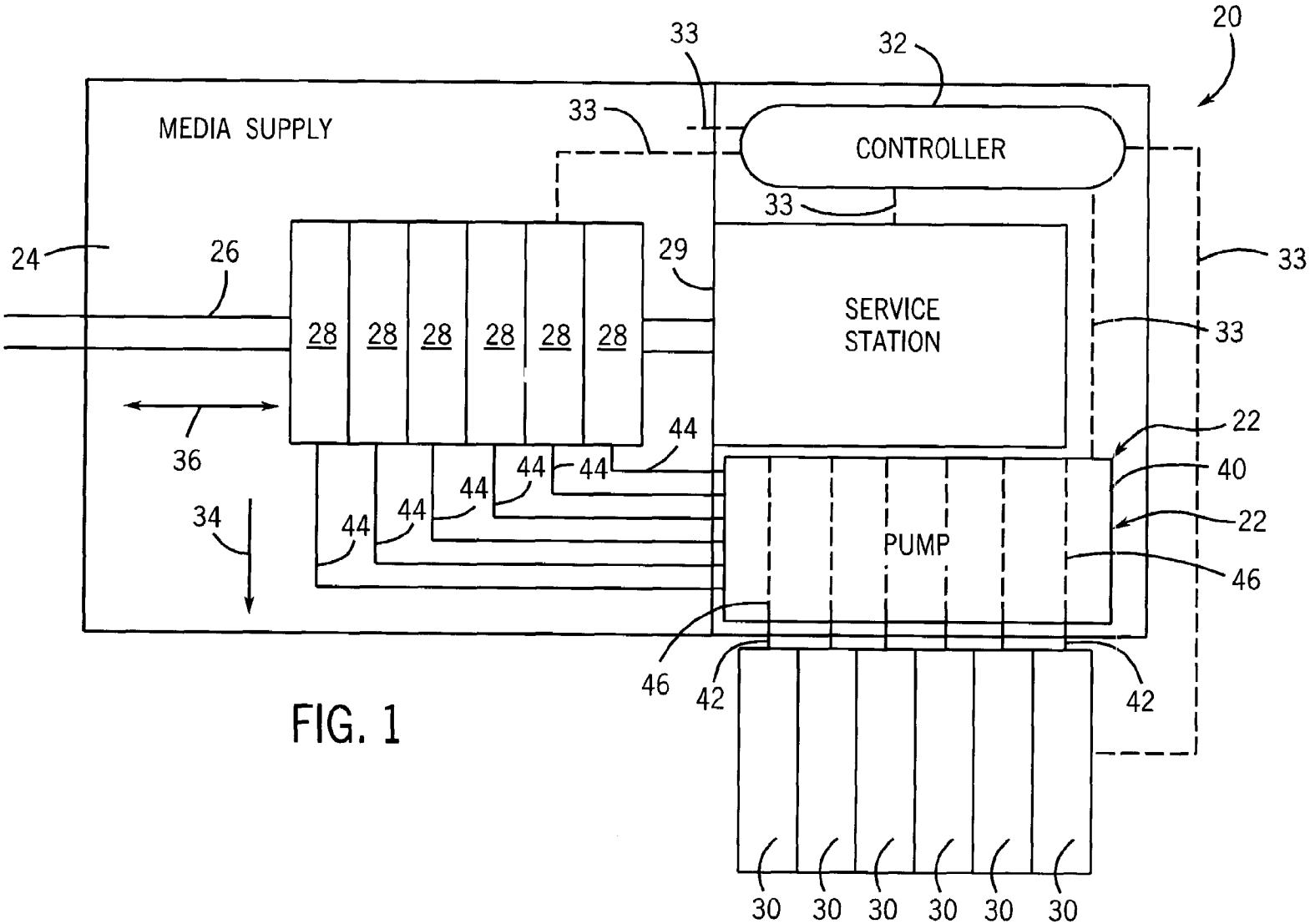
FIG. 1 schematically illustrates a printer utilizing one example of a peristaltic pump of the present invention.

FIG. 1 schematically illustrates printer 20 utilizing one example of a fluid delivery system 22 of the present invention. In addition to fluid delivery system 22, printer 20 includes media supply 24, carriage 26, pens 28, ink supplies 30 and controller 32. Media supply 24 comprises a mechanism configured to supply and position media, such as paper, relative to carriage 26 and pens 28. Carriage 26 comprises a mechanism for moving pens 28 relative to the medium provided by media supply 24. In the particular embodiment illustrated, media supply 24 moves the medium relative to carriage 26 and pens 28 in the direction indicated by arrow 34 while carriage 26 moves pens 28 repeatedly across the medium in the directions indicated by arrow 36. Pens 28 (also known as print cartridges) comprise pens including printheads with nozzles for dispensing fluid ink upon the medium. Service station 29 is a conventionally known service station configured to service pens 28. Examples of servicing operations include wiping, spitting, and capping. Ink supplies 30 provide ink reservoirs containing one or more chromatic or achromatic inks for pens 28. Ink supplies 30 and fluid delivery system 22 function as an ink supply system for printer 20.

Fluid delivery system 22 moves ink from ink supplies 30 to pens 28. Fluid delivery system 22 includes peristaltic pump 40 and fluid ink conduits 42, 44. As will be described in greater detail hereafter, peristaltic pump 40 includes pumping tubes 46. Fluid conduits 42 fluidly connect the ink reservoirs provided by ink supplies 30 to pumping tubes 46. For purposes of this disclosure, the terms "fluidly connect," "in fluid communication" or "in fluid connection" shall mean two or more members having fluid containing volumes that are connected or plumbed to one another by one or more fluid passages enabling fluid to flow between the volumes in one or both directions. Such fluid flow may be temporarily cessated by selective actuation of valve devices. Fluid conduits 44 fluidly interconnect pumping tubes 46 to pens 28. The actual length of conduits 42 and 44 may vary depending upon the actual proximity of ink supplies 30, pump 40 and maximum/minimum distance between pens 28 and pump 40. In particular applications, conduits 42 and 44 are releasably connected to pumping tubes 46 by fluid couplers. In alternative embodiments, one of conduits 42, 44 or both of conduits 42, 44 may be integrally formed as part of a single unitary body with pumping tubes 46. In the embodiment shown, conduits 42 and 44 have a smaller cross sectional flow area as compared to pumping tubes 46 such that pumping tubes 46 may be optimally sized for higher pumping rates. In alternative embodiments, conduits 42, 44 and pumping tubes 46 may have similar internal cross sectional flow areas. In the particular embodiment illustrated, each of the plurality of conduits 44, each of the plurality of conduits 42 and each of the plurality of tubes 46 are substantially identical to one another. In alternative embodiments, pump 40 may be provided with different individual pumping tubes 46, different individual conduits 42 or different individual conduits 44. Although pumping tubes 46 include a flexible wall portion enabling pumping tubes 46 to be compressed, conduits 42 and 44 may be provided by flexible tubing or may be provided by inflexible tubing or other structures having molded or internally formed fluid passages. Although printer 20 is illustrated as having six pens 28, six ink supplies 30, six pumping tubes 46, six conduits 42 and six conduits 44, printer 20 may alternatively have a greater or fewer number of such components depending upon the number of different inks utilized by printer 20.

Controller 32 communicates with media supply 24, carriage 26, pens 28, ink supplies 30 and fluid delivery system 22 via communication lines 34 in a conventionally known manner to form an image upon medium 24 utilizing ink supplied from ink supplies 30. Controller 32 comprises a conventionally known processor unit. For purposes of this disclosure, the term "processor unit" shall include a processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 32 is not limited to any specific combination of hardware circuitry and software, nor to any particular source for the instructions executed by the processing unit.

Although fluid delivery system 22 is illustrated as being employed in a printer 20 in which both the medium 25 and pens 28 are moved relative to one another to form an image upon a medium, fluid delivery system 22 may alternatively be employed in other printers to move fluid ink from one or more ink supplies to one or more ink-dispensing printheads or nozzles. For example, fluid delivery system 22 may alternatively be employed in a printer in which stationary ink-dispensing nozzles are provided across a medium as the medium is moved in the direction indicated by arrow 34. This printer is commonly referred to as a page-wide-array printer. In still other embodiments, fluid delivery system 22 may be employed other image-forming devices wherein fluid ink is deposited upon a medium by means other than pens or printheads or wherein the medium itself is held generally stationary as the ink is deposited upon the medium. Overall, fluid delivery system 22 may be utilized in any image-forming device which utilizes ink or other fluid to be deposited upon a medium.

Pump 40

Figure 2:
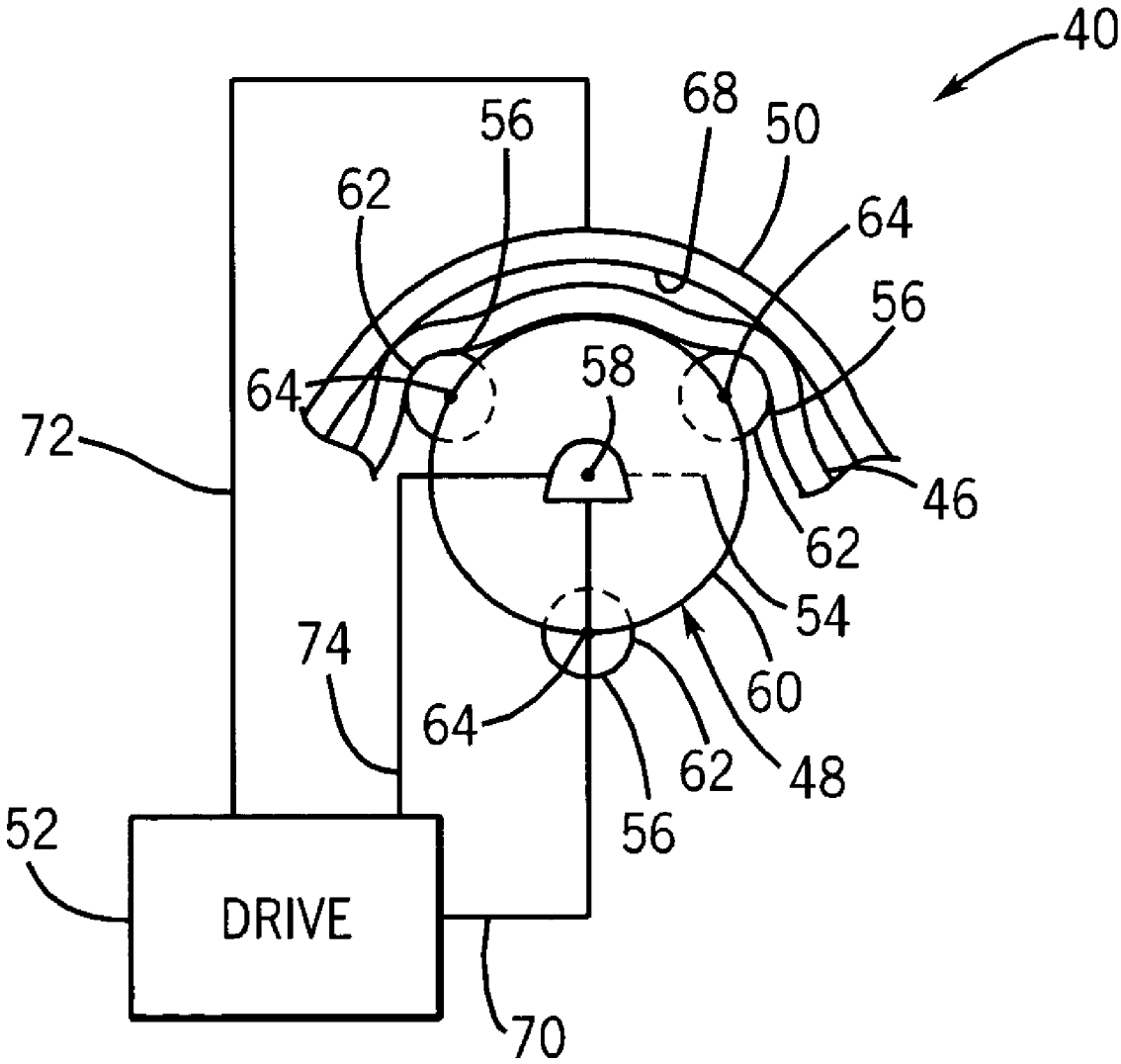
FIG. 2 schematically illustrates the pump of FIG. 1 in greater detail.

FIG. 2 schematically illustrates an embodiment of pump 40 in greater detail. Pump 40 generally include occluding system 48, occlusion 50 and drive system 52. Occluding system 48 generally includes a support 54 rotatably supporting a plurality of occluding surfaces 56 for rotation about axis 58 on a first side of pumping tubes 46. In the particular embodiment illustrated, occluding system 48 comprises a roller assembly having at least one roller support 60 supporting three circumferentially spaced rollers 62 which provide occluding surface 56. Roller support 60 rotates about axis 58 while rotatably supporting each of rollers 62 about their respective axes 64. In alternative embodiments, roller support 60 may support a greater or fewer number of spaced rollers 62. In still other embodiments, rollers 62 may be stationarily supported relative to roller support 60. An example of one particular roller assembly having a plurality of rollers rotatably supported by roller supports which are rotated is provided in copending U.S. patent application Ser. No. 10/647,496 entitled "Printer, Ink Supply System and Peristaltic Pump", filed on Aug. 25, 2003 by Jeremy A. Davis, Melissa S. Gedraitis and Kevin D. Koller, the full disclosure of which is hereby incorporated by reference.

Occlusion 50 generally comprises one or more structures having occlusion surfaces 68. Surfaces 68 extend opposite at least one of occluding surfaces 56 with pumping tubes 46 extending between surfaces 56 and 68. During operation of pump 40, surfaces 56 and 68 contact or engage opposite sides of pumping tubes 46 as surfaces 56 are rotated about axis 58. At least one of occlusion surfaces 68 and occluding surfaces 56 are movable relative to pumping tube 46 and relative to each other so as to move between a tube compressing state and a tube uncompressed state. In the tube compressing state, occluding surfaces 56 and occlusion surfaces 68 compress tubes 46 to facilitate the pumping of fluid through tubes 46 as a result of surfaces 56 being rotated about axis 58. In the tube uncompressed state, surfaces 56 and 68 are sufficiently spaced from one another so as to avoid permanent sets in tubes 46. In one embodiment, surfaces 68 and 56 are spaced apart from one another by a distance greater than the thickness or diameter of each pumping tubes 46.

Drive system 52 comprises a system configured to rotate occluding surfaces 56 about axis 58. At the same time, drive system 52 is also coupled to one or both of support 54 and occlusion 50 so as to move at least one of occlusion 50 and support 54 with the occluding surfaces 56 it carries between the above-described tube compressing state and tube uncompressed state. For purposes of this application, the phrase "between the tube compressing state and the tube uncompressed state" means that drive system 52 either: (1) moves occlusion surfaces 68 towards occluding surfaces 56 and the tube compressing state, (2) moves occlusion surfaces 68 away from occluding surfaces 56 and towards the tube uncompressed state, (3) moves both occluding surfaces 68 and occluding surfaces 56 towards one another, towards tubes 46 and towards the tube compressing state, (4) moves both occlusion surfaces 68 and occluding surfaces 56 away from one another, away from tubes 46 and towards the tube uncompressed state, (5) moves support 54 and occluding surfaces 56 carried by support 54 towards occlusion surfaces 68 and towards the tube compressing state or (6) moves support 54 and occluding surfaces 56 carried by support 54 away from occlusion surfaces 68 and towards the tube uncompressed state.

The coupling of drive system 52 to occluding surfaces 56 so as to rotate occluding surfaces 56 about axis 58 is schematically represented by coupler line 70. This coupling may be achieved by multiple arrangements. For example, drive system 52 may comprise a motor (hydraulic, pneumatic or electrical) having an output shaft connected to roller support 60 by a drive train formed by intermeshing gears, a chain and sprocket arrangement or a belt and pulley arrangement. In particular embodiments, the output shaft of the motor may be directly coupled to roller support 60. In one particular embodiment, drive system 52 is configured to selectively rotate occluding surfaces 56 about axis 58 in opposite directions. In still other embodiments, drive system 52 may be configured to rotate occluding surfaces 56 about axis 58 in only a single direction.

For purposes of this disclosure, the term "coupled" means the joining of two members directly or indirectly to one another. Such joining may be stationary in nature or movable in nature. For example, when two members are "stationarily coupled" to one another, they are immovable relative to one another. When two members are "movably coupled" to one another, at least one of the members is movable relative to the other member. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" means that two movable members are arranged so as to directly or indirectly interact with one another so that force and motion are transmitted from one member to the other.

The coupling of drive system 52 to occlusion 50 and occlusion surfaces 68 is schematically represented by coupler line 72. Such coupling may be provided by various linkages, drive trains and the like between drive system 52 and occlusion 50. In one embodiment, drive system 52 includes a motor which is movably supported such that the torque provided by the motor to rotate occluding surfaces 56 about axis 58 also linearly moves the motor. Coupler 72 comprises one or more linkage members operably coupled between the motor and occlusion 50 such that movement of the motor moves occlusion 50. Specific examples of such an arrangement are shown and described with respect to FIGS. 3-12.

In still another alternative embodiment, drive system 52 includes a stationary motor which rotates an output shaft to rotate occluding surfaces 56 about axis 58. The output shaft is also operably coupled to coupler 72 so as to move occlusion 50. A specific example of such an arrangement is shown and described with respect to FIG. 13.

In still another embodiment, drive system 52 includes a stationarily supported motor. The motor rotates an output shaft which is coupled to occluding surfaces 56 so as to rotate occluding surfaces 56 about axis 58 and which is also coupled to support 54 by coupler 74 so as to also move support 58. In one embodiment, the output shaft rotates a worm such as engagement with a rack gear coupled to support 58 so as to generally move support 54 or a linkage operably coupled to support 54.

The coupling of drive system 52 to support 54 and occluding surfaces 56 is schematically represented by coupler line 74. In one embodiment, drive system 52 includes a motor movably supported, wherein the motor itself is coupled to support 54 by one or more linking structures. The motor's rotation of an output shaft to rotate occluding surfaces 56 about axis 58 also moves the motor which in turn moves support 54. An example of such an arrangement is shown and described with respect to FIGS. 14 and 15.

Overall, pump 40 prevents pumping tubes 46 from permanently setting as a result of being compressed when pump 40 is not being utilized. Because pump 40 utilizes the same drive system 52 to rotate occluding surfaces 56 about axis 58 so as to pump fluid through tubes 46 and to also move one or both of occlusion 50 and support 58 with the occluding surfaces 56 it carries, pump 40 is more compact and less costly to manufacture. Although printer 20 and pump 40 have been illustrated as pumping fluid through six pumping tubes 46, pump 40 may alternatively be used to pump fluid through a single pumping tube or any of a number of pumping tubes as desired.

Pump 140

FIGS. 3-6 schematically illustrate pump 140, a first alternative embodiment of pump 40. Pump 140 generally includes base 142, occluding system 148, occlusion 150, drive system 152, coupler 172, occlusion bias mechanism 174, limit surfaces 175, 176, coupling bias mechanism 178 and position sensor 180. Although pump 140 is illustrated for pumping fluid through a single tube 46, for ease of illustration, pump 140 may be modified by increasing the axial length of occlusion 150 and occluding system 148 to pump fluid through a larger number of tubes 46. Base 142 generally comprises a frame, housing or other structure configured to serve as a stationary ground by which the remaining components of pump 140 are supported. Base 142 may have a variety of sizes, shapes and configurations depending upon the application and use of pump 140.

Occluding system 148 is substantially identical to occluding system 48 shown and described with respect to FIG. 2. In pump 140, support 54 is stationarily supported or fixed relative to base 142 by rotatably supporting roller support 60. Roller support 60 is rotatably journaled to support 54, while each of rollers 62 is rotatably journaled to support 60 for rotation about an axis 64. Rollers 62 provide occluding surfaces 56.

Figure 3:
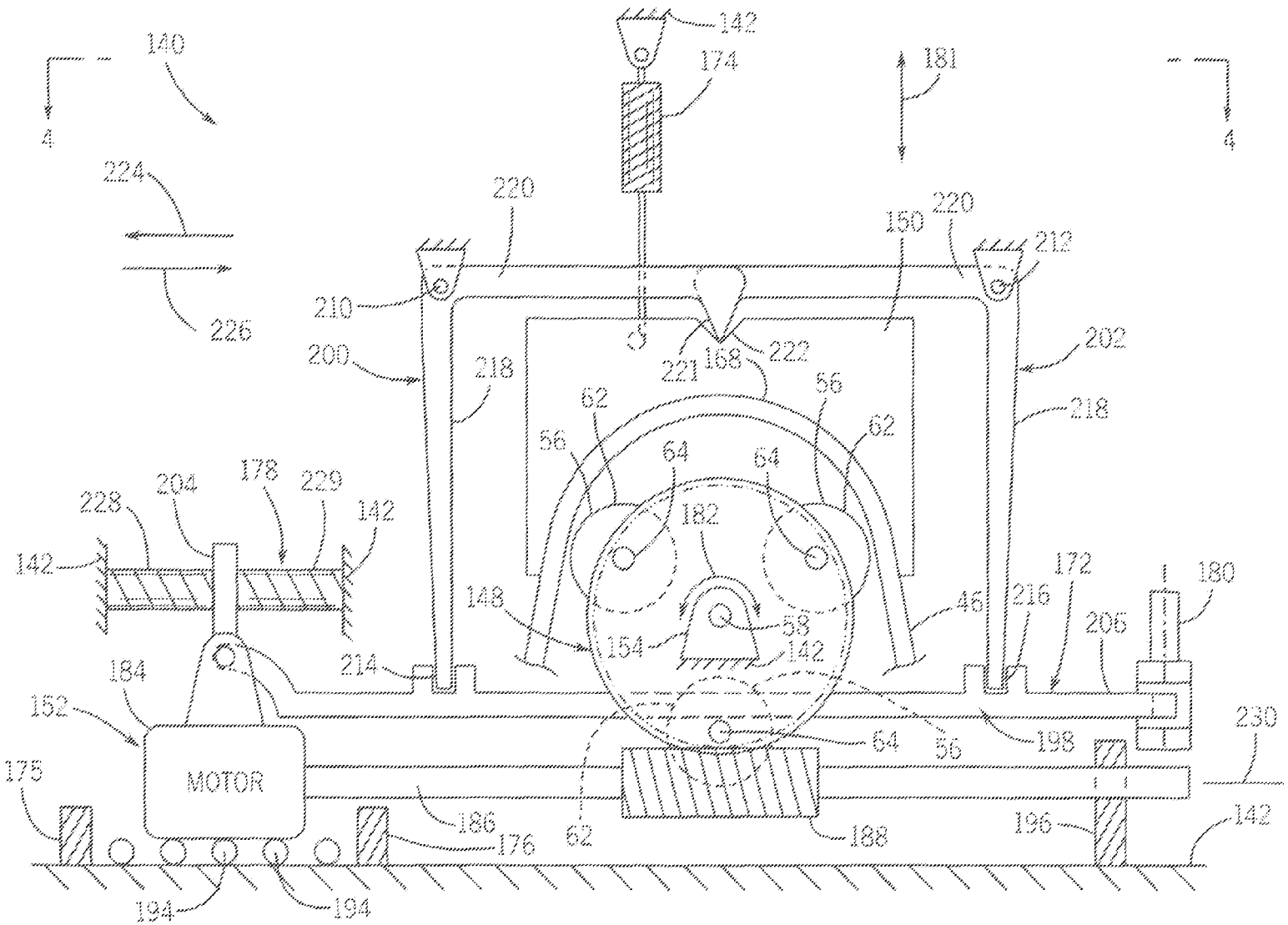
FIG. 3 is a front elevational view schematically illustrating a first alternative embodiment of the pump of FIG. 2 in a non-pumping state.
Figure 4:
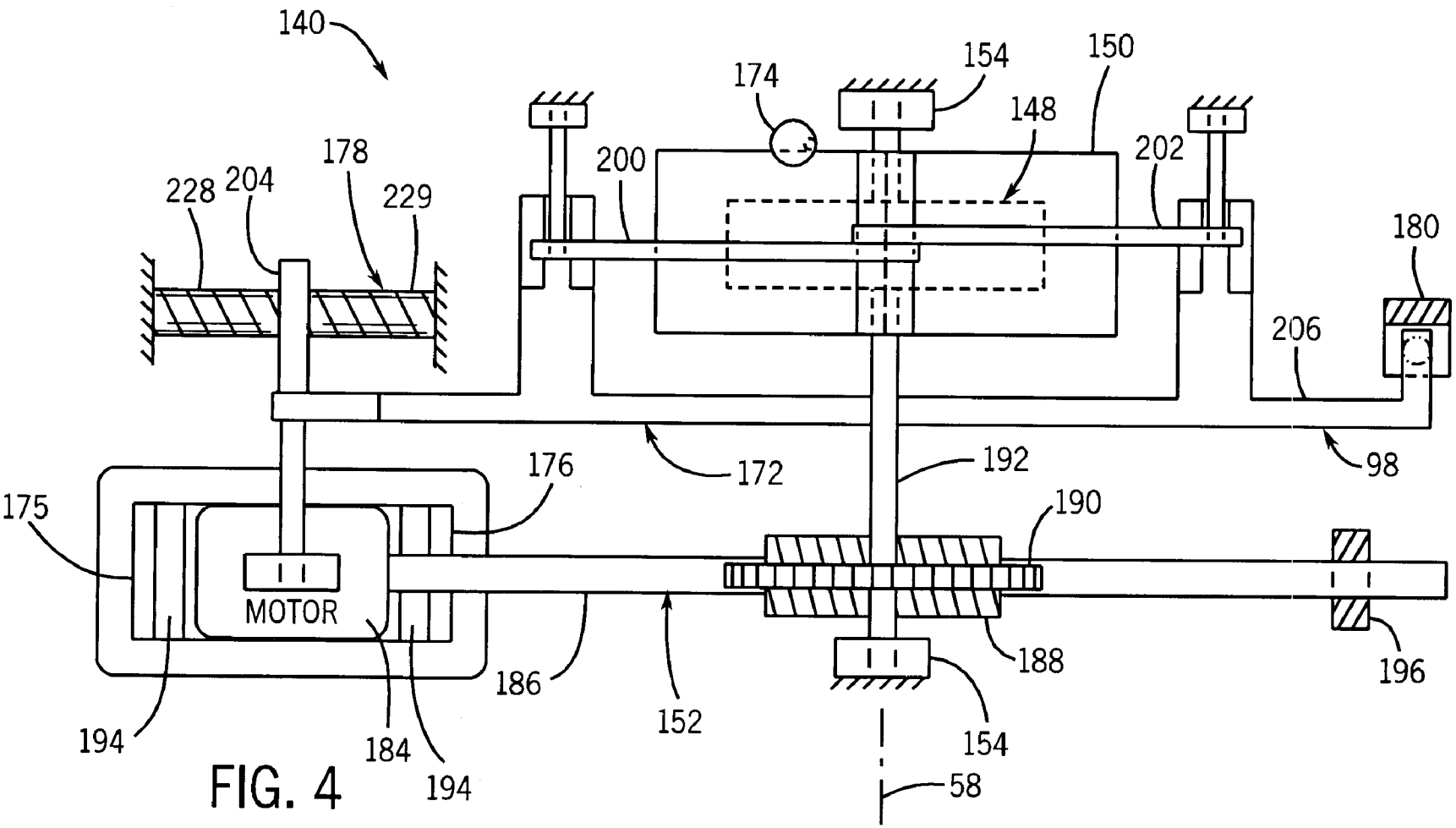
FIG. 4 is a top plan view schematically illustrating the pump of FIG. 3.

Occlusion 150 (also known as an occlusion bed) provides one or more structures which are supported for movement in the directions indicated by arrows 181 (shown in FIG. 3). Occlusion 150 includes occlusion surfaces 168 opposite pumping tube 46. Occlusion 150 extends on a first side of pumping tube 46 while occluding surfaces 56 extend on an opposite side of pumping tube 46. Occlusion 150 cooperates with occluding surfaces 56 to enable the pumping of fluid through tube 46.

Drive system 152 is configured to rotatably drive occluding surfaces 56 about axis 58 in either direction as indicated by arrows 182. Drive system 152 includes motor 184, output shaft 186, worm 188, worm gear 190 and occluding system input shaft 192. Motor 184 generally comprises a motor configured to provide rotational mechanical energy or torque to output shaft 186. In the embodiment illustrated, motor 184 comprises an electrically powered motor. In alternative embodiments, motor 184 may comprise a hydraulic motor, a pneumatic motor, a battery-powered motor, an engine or other form of a rotational actuator. In the particular embodiment illustrated, motor 184 is configured to rotatably drive output shaft 186 in both clockwise and counter-clockwise directions so as to drive occluding system 148 in either direction to pump fluid in two directions. In alternative embodiments, motor 184 may be configured to rotatably drive output shaft 186 in only a single direction.

As schematically illustrated in FIG. 3, motor 184 is movably supported relative to base 142. In the particular embodiment illustrated, motor 184 is movably supported by a plurality of roller bearings 194 between motor 184 and base 142. In alternative embodiments, motor 184 may be movably supported by various other arrangements facilitating movement of motor 184. For example, other bearings may be used in lieu of roller bearings. In some applications, motor 184 may be slidably supported relative to base 142 by a tongue-and-groove arrangement or may be supported on rails. Although motor 184 is illustrated as being movable in a linear direction generally perpendicular to axis 158, motor 184 may alternatively be supported for movement in a linear direction parallel to axis 58 depending upon the configuration of the remaining components of pump 140.

Output shaft 186 extends from motor 184 and has an opposite end journaled at post 196 extending from base 142.

Worm 188 is fixedly coupled to output shaft 186 and is in meshing engagement with worm gear 190. Worm 188 has an axial length sufficient so as to remain in engagement with worm gear 190 when motor 184 is positioned against limit surface 175 or limit surface 176. Worm gear 190 is fixedly coupled to input shaft 192. Input shaft 192 is rotatably supported by supports 154 and is fixedly coupled to roller support 60 of occluding system 148. During operation of pump 140, motor 184 rotates output shaft 186 and worm 188 which transmit torque to input shaft 192 through worm gear 190. Rotation of input shaft 192 results in rotation of roller support 60 and occluding surfaces 56 about axis 58.

Coupler 172 operably couples motor 184 to occlusion 150 such that movement of motor 184 results in a force being exerted upon occlusion 150 to move occlusion 150. Coupler 172 includes motor extension 198 and pivotable arms 200, 202. Extension 198 comprises one or more structures extending from motor 184 between motor 184 and arms 200, 202. In the embodiment illustrated, extension 198 includes mounting ear portion 204 and leg 206. Mounting ear portion 204 is fixedly coupled to motor 184 and is operably engaging motor bias mechanism 178.

Leg 206 extends from mounting portion 204 in a direction generally parallel to output shaft 186. Leg 206 is operably coupled to each of arms 200 and 202 such that movement of leg 206 along an axis parallel to output shaft 186 pivots arms 200 and 202 about axes 210 and 212, respectively. In the particular embodiment illustrated, leg 206 includes channels 214 and 216 which slidably receive portions of arms 200 and 202, respectively. In alternative embodiments, leg 206 may be operably coupled to arms 200 and 202 in a variety of other manners. For example, leg 206 may be pivotably coupled to arms 200 and 202 so as to pivot about axes generally parallel to axes 210 and 212, respectively. Although leg 206 is illustrated as being pivotably coupled to mounting portion 204, leg 206 may alternatively be fixedly coupled to mounting portion 204. In particular applications, mounting portion 204 may be omitted wherein leg 206 extends directly from motor 184.

Arms 200 and 202 extend between leg 206 and occlusion 150 on opposite sides of axis 58. Each of arms 200 and 202 is pivotably supported relative to frame 142. Each arm 200, 202 has a leg-engaging portion 218 and occlusion-engaging portion 220 on the opposite sides of the pivot point of the pivotable arm. Each occlusion engaging portion 220 includes a tooth 221 configured to engage a corresponding notch 222 formed in occlusion 150. The interaction between tooth 221 and notch 222 to facilitate the proper movement and positioning of occlusion 150 and its occlusion surface 168 relative to occluding surfaces 56 when moved to the tube-compressing state. Movement of leg 206 pivots both of arms 200 and 202 such that one occlusion-engaging portion 220 is moved towards occlusion 150, while the other of occlusion-engaging portions 220 is withdrawn away from occlusion 150.

Occlusion bias mechanism 174 is coupled between base 142 and occlusion 150 and is configured to resiliently bias occlusion 150 away from axis 58 and occluding surfaces 56 and towards the tube uncompressed state. In the particular embodiment illustrated, bias 174 comprises a tension spring having a first end coupled to base 142 and a second opposite end coupled to occlusion 150. In the particular embodiment illustrated, occlusion 150 is movably supported in a track or groove which guides movement of occlusion 150 in the direction indicated by arrows 181. In alternative embodiments, occlusion 150 may be guided by other guiding structures.

Limit surfaces 175 and 176 are fixedly coupled to base 142 and are configured to limit travel of motor 184. In particular, limit surface 175 limits travel of motor 184 in the direction indicated by arrow 224. Limit surface 176 limits travel of motor 184 in the direction indicated by arrow 226. Surfaces 175 and 176 are located so as to prevent arms 200 and 202 from being pivoted to such an extent occlusion 150 is moved too close to occluding surfaces 56 and to prevent tube 46 from being overly compressed. Although limit surfaces 175 and 176 are illustrated as engaging motor 184 to limit travel of motor 184, limit surfaces 175 and 176 may alternatively engage other portions of drive system 152 to control the extent to which motor 152 is moved.

Motor bias mechanism 178 resiliently biases motor 184 and drive system 152 toward a predetermined neutral position such that occlusion 150 is in the tube uncompressed state. In the particular embodiment illustrated, bias mechanism 178 comprises compression springs 228, 229 coupled between mounting portion 204 and base 142. Each of springs 228, 229 exerts an equal force upon portion 204 to resiliently bias motor 184 to a neutral position as shown in FIG. 3.

Position sensor 180 comprises a sensor configured to sense the position of occlusion 150 relative to axis 58 and occluding surfaces 56. In the embodiment illustrated, position sensor 180 detects the position of occlusion 150 by sensing the position of drive system 152 in a direction parallel to axis 230. Sensor 180 generates signals representing the position of leg 206 corresponding to a position of occlusion 150. The signals are transmitted to controller 32 (shown in FIG. 1) which uses such signals to control the speed and the direction at which motor 184 drives output shaft 186. In the embodiment illustrated, sensor 180 comprises an optical sensor. In alternative embodiments, sensor 180 can be comprised from a variety of alternative sensors such as magnetic sensors and the like.

Figure 5:
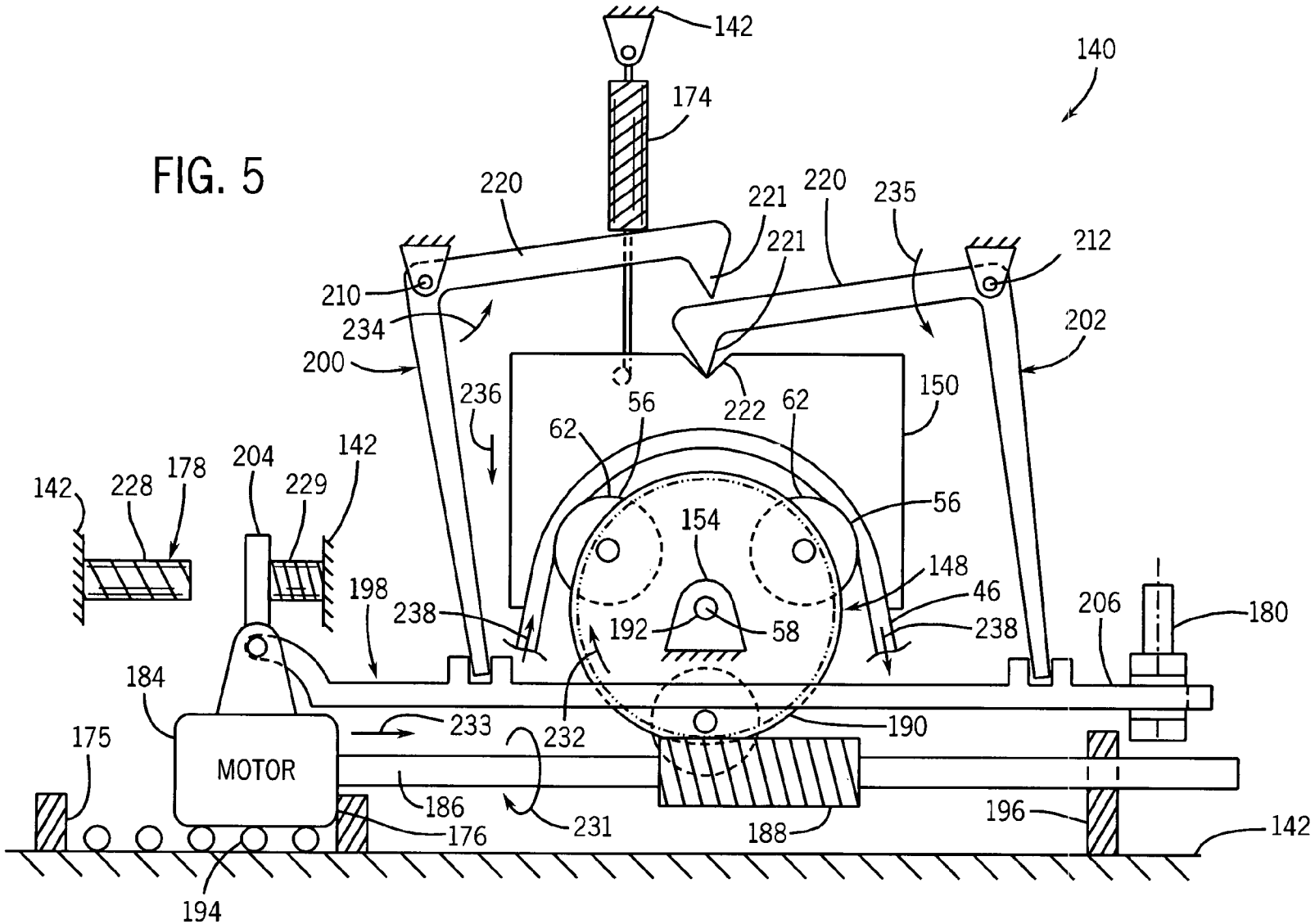
FIG. 5 is a side elevational view schematically illustrating the pump of FIG. 3 in a fluid-pumping state in which fluid is being pumped in a first direction.
Figure 6:
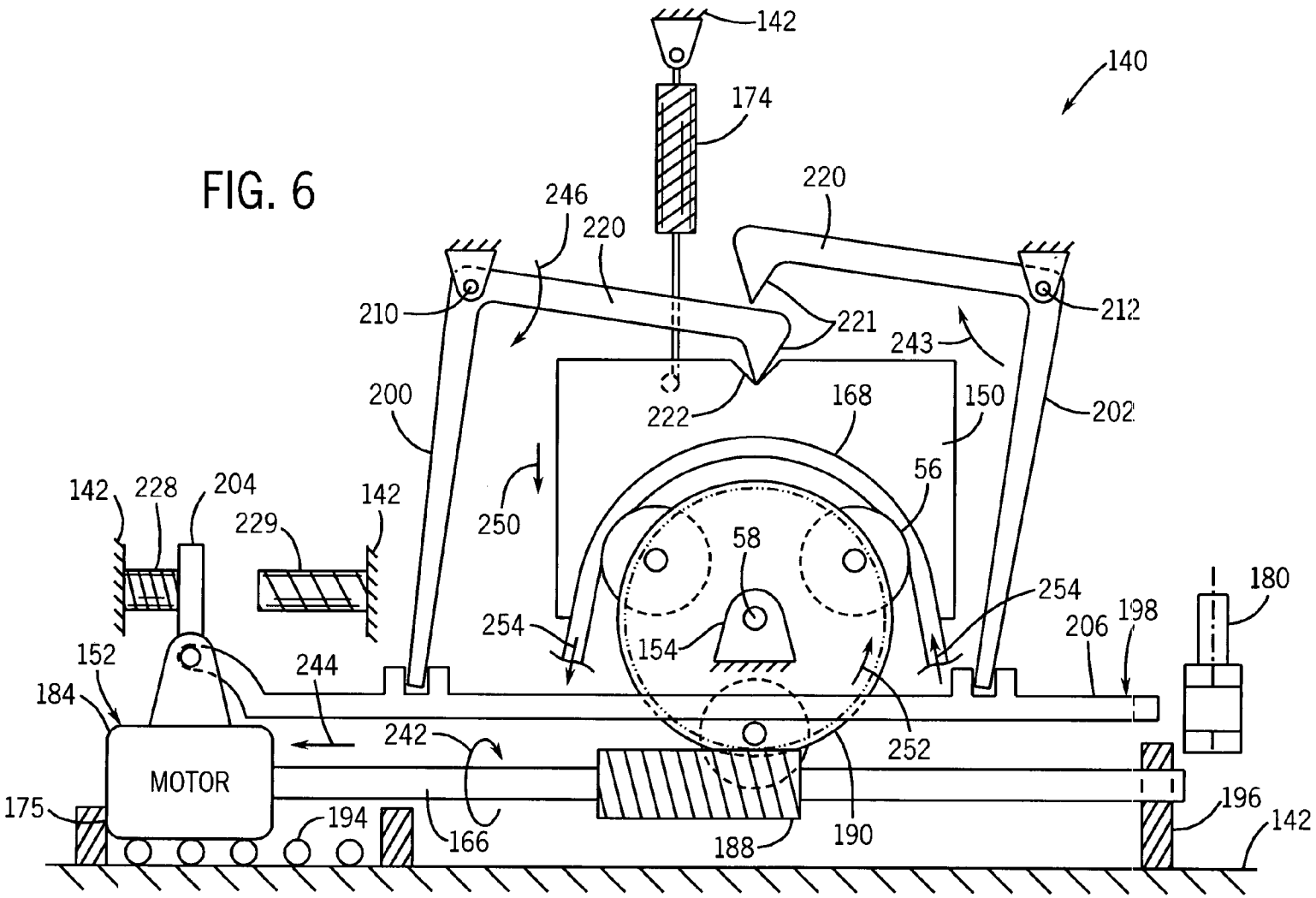
FIG. 6 is a side elevational view schematically illustrating the pump of FIG. 3 in a fluid-pumping state in which fluid is being pumped in a second opposite direction.

FIGS. 3, 5 and 6 illustrate the operation of pump 140 according to an example embodiment. FIG. 3 illustrates pump 140 when occlusion 150 and occluding surfaces 56 are in a tube uncompressed state. FIG. 3 illustrates pump 140 when motor 184 is no longer rotating output shaft 186. As a result, springs 228, 229 move motor 184 in a neutral position between limit surfaces 175 and 176. Movement of motor 184 to the neutral position pivots arms 200 and 202 to the position shown such that both occlusion engagement portions 220 of both arms 200 and 202 are pivoted away from occluding surfaces 56. Bias mechanism 174 biases occlusion 150 away from occluding surfaces 56 in a direction generally perpendicular to axis 58. In the embodiment illustrated, occlusion surfaces 168 are spaced from the circumferential outer path of occluding surfaces 56 by a distance sufficient such that tube 46 does not experience a permanent set. In the particular embodiment illustrated, the space between occluding surfaces 68 and the circumferential outer path 239 of occluding surfaces 56 is greater than the thickness or diameter of tube 46.

FIG. 5 illustrates pump 140 with occlusion 150 and occluding surfaces 56 in a tube-compressing state. In particular, FIG. 5 illustrates motor 184 rotatably driving output shaft 186 in the direction indicated by arrow 231. As a result, worm 188 drives worm gear 190 to rotate input shaft 192 and occluding system 148 about axis 58 as indicated by arrow 232. The engagement of worm 188 with cylindrical gear 190 also exerts a force upon motor 184 to move motor 184 in the direction indicated by arrow 233. As shown by FIG. 5, motor 184 generally moves in the direction indicated by arrow 233 until abutting limit surface 176. As motor 184 moves in the direction indicated by arrow 233, mounting portion 204 compresses one of spring 229 and leg 206 simultaneously pivots arm 200 about axis 210 in the direction indicated by arrow 234 and pivots arm 202 about axis 212 in the direction indicated by arrow 235. As a result, occlusion-engaging portion 220 of arm 202 engages and applies a force to occlusion 150 so as to move occlusion 150 against bias mechanism 174 towards occluding surfaces 56 in the direction indicated by arrow 236. Occlusion surface 150 is moved sufficiently close to occluding surfaces 56 such that tubes 46 are progressively and successively compressed by occluding surfaces 56 as occluding surfaces 56 are rotatably driven about axis 58. This results in fluid being pumped through tubes 46 in the direction indicated by arrows 238.

FIG. 6 illustrates pump 140 during the pumping of fluid through tubes 46 in an opposite direction as to that shown in FIG. 5. In particular, FIG. 6 illustrates occlusion 150 and occluding surfaces 56 in the tube-compressing state as motor 184 rotatably drives output shaft 186 in the direction indicated by arrow 242. The engagement of worm 188 with worm gear 190 exerts a force upon motor 184 so as to move motor 184 in the direction indicated by arrow 244. Motor 184 moves in the direction by arrow 244 until engaging limit surface 175. During movement of motor 184, mounting portion 204 compresses spring 228 and simultaneously moves leg 206 to pivot arm 200 about axis 210 in the direction indicated by arrow 246 and to also pivot arm 202 about axis 212 in the direction indicated by arrow 248. As a result, occlusion engagement portion 220 of arm 200 is brought into engagement with occlusion 150 so as to exert a force upon and move occlusion 150 in the direction indicated by arrow 250 towards occluding surfaces 56 against bias mechanism 174. Occlusion 150 is brought into sufficient proximity with the outer circumferential path of occluding surfaces 56 such that that rotation of occluding surfaces 56 about axis 58 in the direction indicated by arrow 252 results in fluid being pumped through tubes 246 in the direction indicated by arrows 254.

Overall, pump 140 is configured to pump fluid through tubes 246 in either direction. Regardless of the direction in which the fluid is being pumped, drive system 15 simultaneously rotates occluding surfaces 56 about axis 58 and moves occluding surfaces 168 and occlusion 150 between the tube-compressing state and the tube uncompressed state. This is achieved without an additional actuator, reducing the cost and complexity of pump 140. In addition, the movement of occluding surfaces 168 between the tube-compressing state and the tube uncompressed state is automatically performed in response to rotation of occluding system 148 and drive system 152.

When occluding system 148 is no longer being driven by drive system 152, occlusion 150 is automatically withdrawn from occluding surfaces 56 to avoid the formation of a permanent set within tubes 46. In particular, when motor 184 stops driving output shaft 186 and worm 188, springs 228 and 229 urge motor 184 to a neutral position shown in FIG. 3. As a result, leg 206 is moved to also pivot arms 200 and 202 to the neutral position shown in FIG. 3, allowing bias mechanism 174 to lift occlusion 150 away from occluding surfaces 56.

Although pump 140 is illustrated as including various optional components, such components may be omitted from alternative embodiments. For example, although pump 140 is illustrated as including motor bias mechanism 178 and limit surfaces 175, 176, limit surfaces 175 and 176 may be omitted where bias mechanism 178 is configured to also limit travel of motor 184. Although pump 140 is illustrated as including sensor 180, sensor 180 may be omitted in particular applications.

Pump 340

Figure 7:
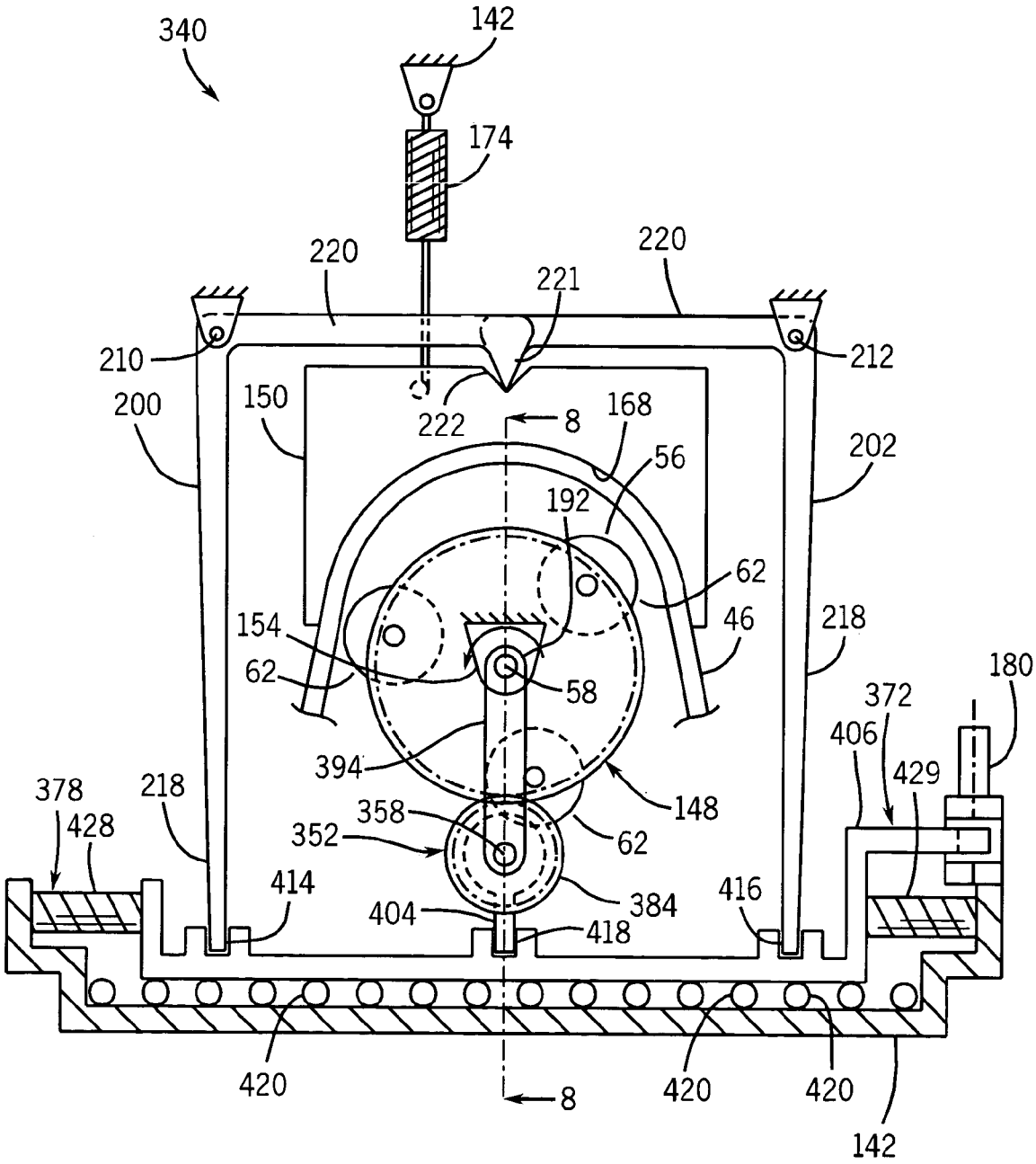
FIG. 7 is a side elevational view schematically illustrating a second alternative embodiment of the pump of FIG. 2 in a non-pumping state.
Figure 8:
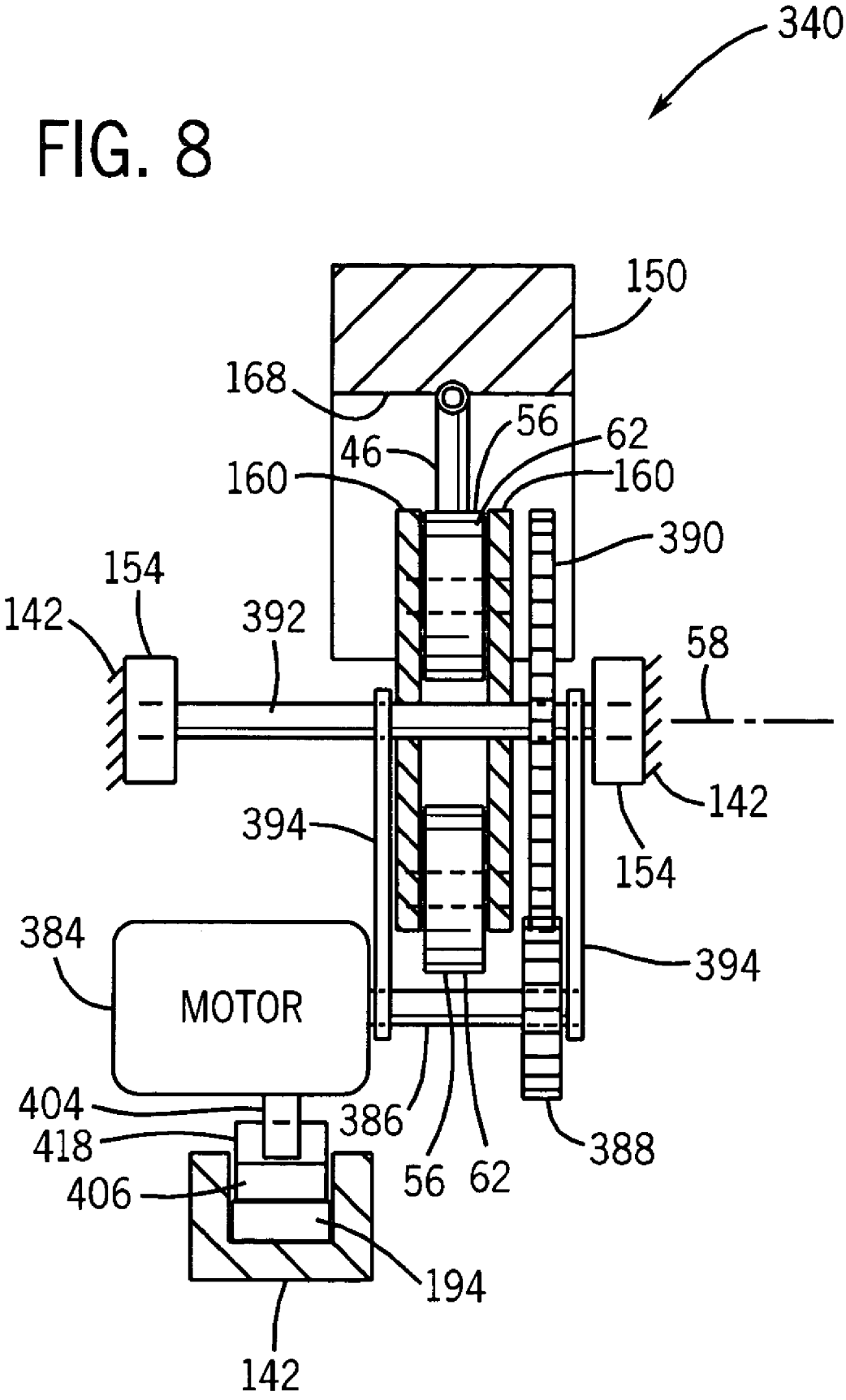
FIG. 8 is a sectional view of the pump of FIG. 7 taken along line 8-8.
Figure 9:
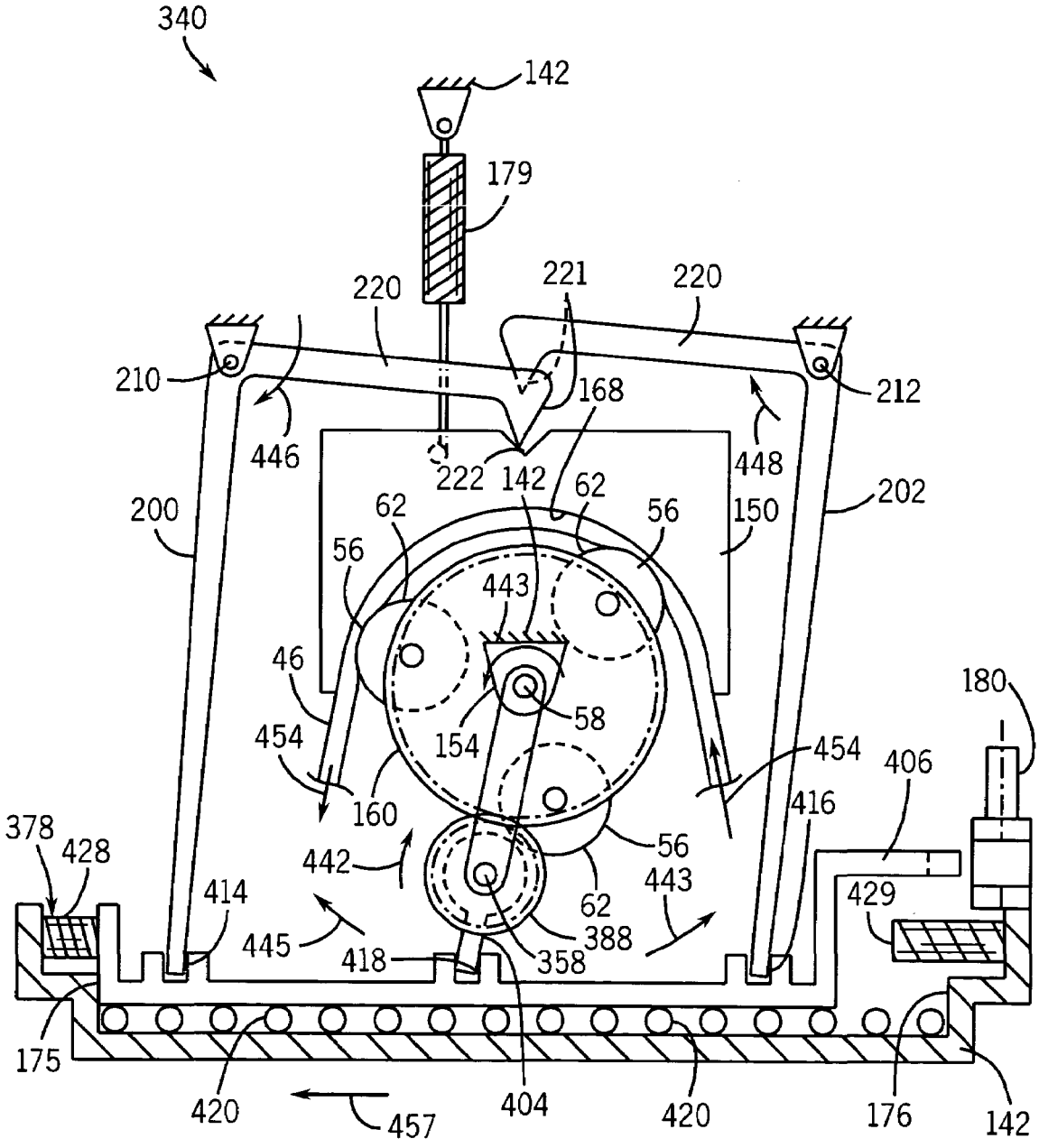
FIG. 9 is a side elevational view schematically illustrating the pump of FIG. 7 in a fluid-pumping state.

FIGS. 7-9 illustrate pump 340, a second alternative embodiment of pump 40 shown and described with respect to FIG. 2. Pump 340 is similar to pump 140 except that pump 340 includes drive system 352, coupler 372 and motor bias mechanism 378 in lieu of drive system 152, coupler 172 and motor bias mechanism 178, respectively. For ease of illustration, those remaining components of pump 340 which are identical or substantially similar to corresponding components of pump 140 are similarly numbered.

Drive system 352 is configured to rotatably drive occluding system 148 about axis 58. At the same time, drive system 352 is configured to also move occlusion 150 between the tube-compressing state and the tube uncompressed state. Drive system 352 generally includes motor 384, output shaft 386, pinion or spur gear 388, spur gear 390 and occluding system input shaft 392. Motor 384 is substantially identical to motor 184 except that motor 384 is pivotally supported relative to base 142. In the particular embodiment illustrated, motor 184 is pivotally supported for pivotal movement about axes 58 and 358 of link 394. Motor 384 provides rotational mechanical energy or torque which rotatably drives output shaft 386 and drives output shaft 392 via the meshing engagement of gears 388 and 390. Input shaft 392 is fixedly coupled to roller supports 160 so that rotation of input shaft 392 rotates roller supports 160 and rollers 62 about axis 58.

Coupler 372 couples drive system 352 to occlusion 150 so that drive system 352 moves occlusion 150 between the tube-compressing state and the tube uncompressed state. Coupler 372 is similar to coupler 172 except that coupler 372 includes leg 406 in lieu of leg 206. Like leg 206, leg 406 is coupled to rotatable arms 200 and 202 and is also coupled to motor 184. In particular, leg 406 includes channels 414 and 416 which receive portions 218 of arms 200 and 202. Leg 406 additionally includes channel 418 which receives extension 404 projecting from motor 384. In alternative embodiments, leg 406 may be operably coupled to arms 200, 202 and extension 404 of motor 384 and other fashions. For example, leg 406 may alternatively be pivotably coupled to arms 200, 202 and extension 404 for pivotal movement about axes generally parallel to axis 58.

Leg 406 is movably supported relative to base 142. In the particular embodiment illustrated, leg 406 is movably supported by a plurality of roller bearings 420 in between base 142 and leg 406. In alternative embodiments, leg 406 may be movably supported relative to base 142 by various other bearing arrangements and any other conventionally known grid arrangements such as tongue-and-grooves and the like. Leg 406 transmits force caused by the movement of motor 384 to arms 200 and 202 to pivot arms 200 and 202 so as to move occlusion 150.

Motor bias mechanism 378 is coupled between base 142 and leg 406. Motor bias mechanism 378 resiliently biases leg 406 and motor 384 towards a pre-selected neutral position in which both engaging portions 220 of arms 200 and 202 are withdrawn away from occluding surfaces 56 and axis 58 such that bias 174 moves and retains occlusion 150 in the tube uncompressed state. In the particular embodiment illustrated, motor bias 378 comprises compression springs 428, 429 on opposite ends of leg 406. In alternative embodiments, bias mechanism 378 may comprise other forms of springs coupled between base 142 and leg 406 or coupled between base 142 and motor 384. As shown by FIG. 7, when motor 384 is not rotatably driving output shaft 386, bias mechanism 378 moves leg 406 and motor 384 towards a neutral position which results in occlusion 150 being withdrawn from occluding surfaces 56. As a result, tube 46 does not develop a permanent set when pump 340 is not being used.

FIG. 9 illustrates pump 340 pumping fluid through tube 46 in the direction indicated by arrows 454. In particular, FIG. 9 illustrates motor 384 rotatably driving output shaft 386 in the direction indicated by arrow 442 about axis 358 to also rotate gear 388 in the same direction. Gear 388, in turn, rotatably drives gear 390 to rotate roller supports 160 and occluding surfaces 56 of rollers 62 about axis 58 in the direction indicated by arrow 443. Interaction between gears 388 and 390 exerts a force upon motor 384, causing motor 384 to rotate about axis 58 in the direction indicated by arrow 445. As a result, extension 404 engages leg 406 to move leg 406 in the direction indicated by arrow 457 to pivot arm 200 about axis 210 in the direction indicated by arrow 446 and to pivot arm 202 about axis 212 in the direction indicated by arrow 448. During such movement, leg 406 compresses spring 428 of bias mechanism 378 until leg 406 abuts limit surface 175. The pivoting of arm 200 about axis 210 moves engaging portion 220 of arm 200 into engagement with occlusion 150 so as to move occlusion 150 against the bias of bias mechanism 174 towards occluding surfaces 56 and into the tube-compressing state. Although not illustrated, rotation of occluding surfaces 56 about axis 58 of motor 384 in an opposite direction results in motor 84 pivoting about axis 58 in the direction indicated by arrow 443. This results in engaging portion 220 of arm 200 being withdrawn from occlusion 150 and engaging portion 220 of arm 202 being moved into engagement with occlusion 150 to move occlusion 150 towards occluding surfaces 56 and into the tube-compressing state. As a result, occluding surfaces 56 progressively compress tube 46 against occlusion 150 to pump fluid through tube 46 in an opposite direction as that indicated by arrows 454.

When motor 384 stops rotating gear 388, occlusion 150 is automatically returned to a neutral position and a non-pumping state. In particular, when motor 384 stops rotating gear 388, springs 428 and 429 urge leg 406 to a neutral position shown in FIG. 7. As a result, legs 200 and 202 are also pivoted about axes 210 and 212 to the neutral position shown in FIG. 7. This allows bias mechanism 174 to move occlusion 150 and its occlusion surface 168 away from occluding surfaces 56 to reduce or eliminate the compression of tube 46 so as to avoid the formation of a permanent set within tube 46.

Pump 540

Figure 10:
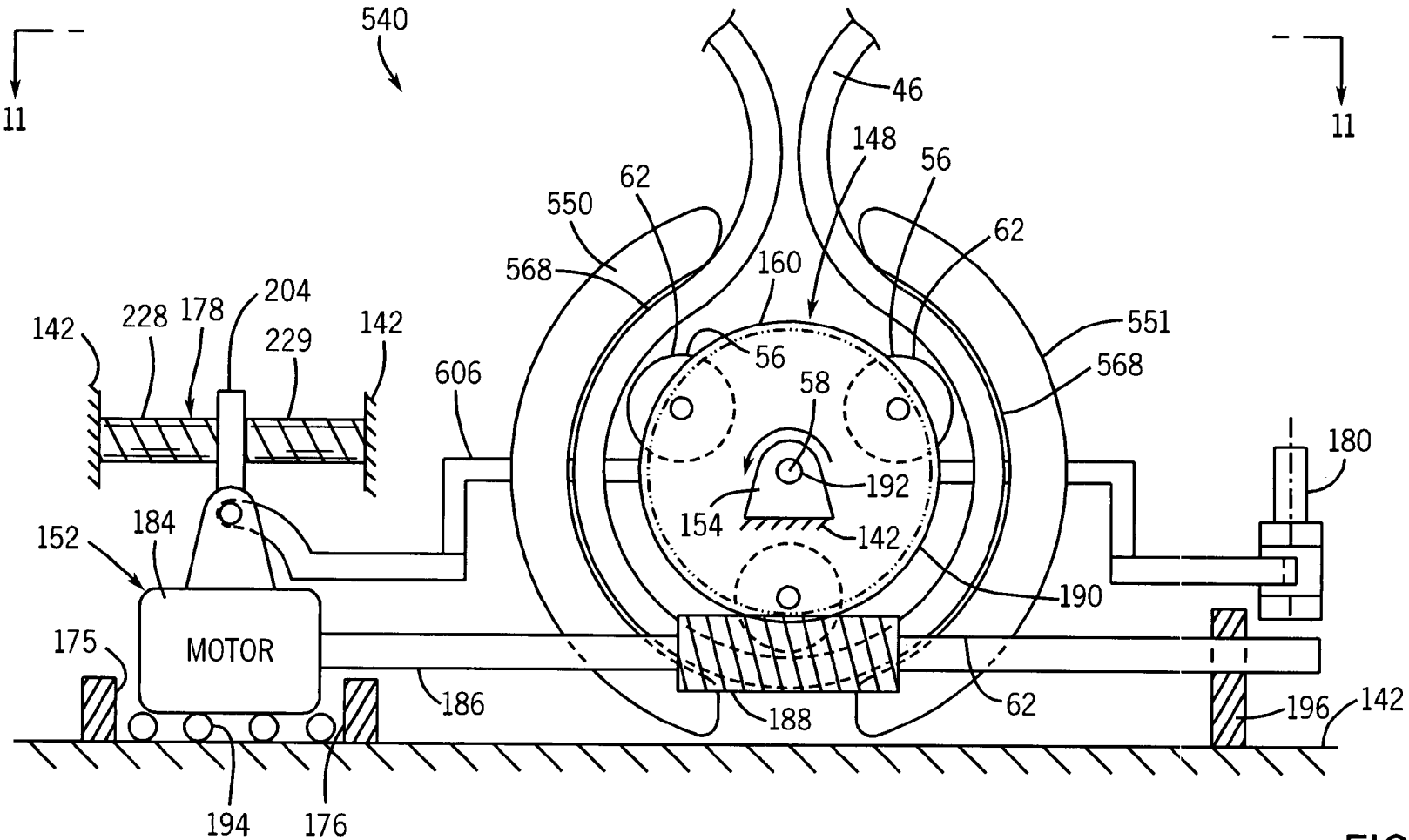
FIG. 10 is a side elevational view schematically illustrating a third alternative embodiment of the pump of FIG. 2 in a non-pumping state.
Figure 11:
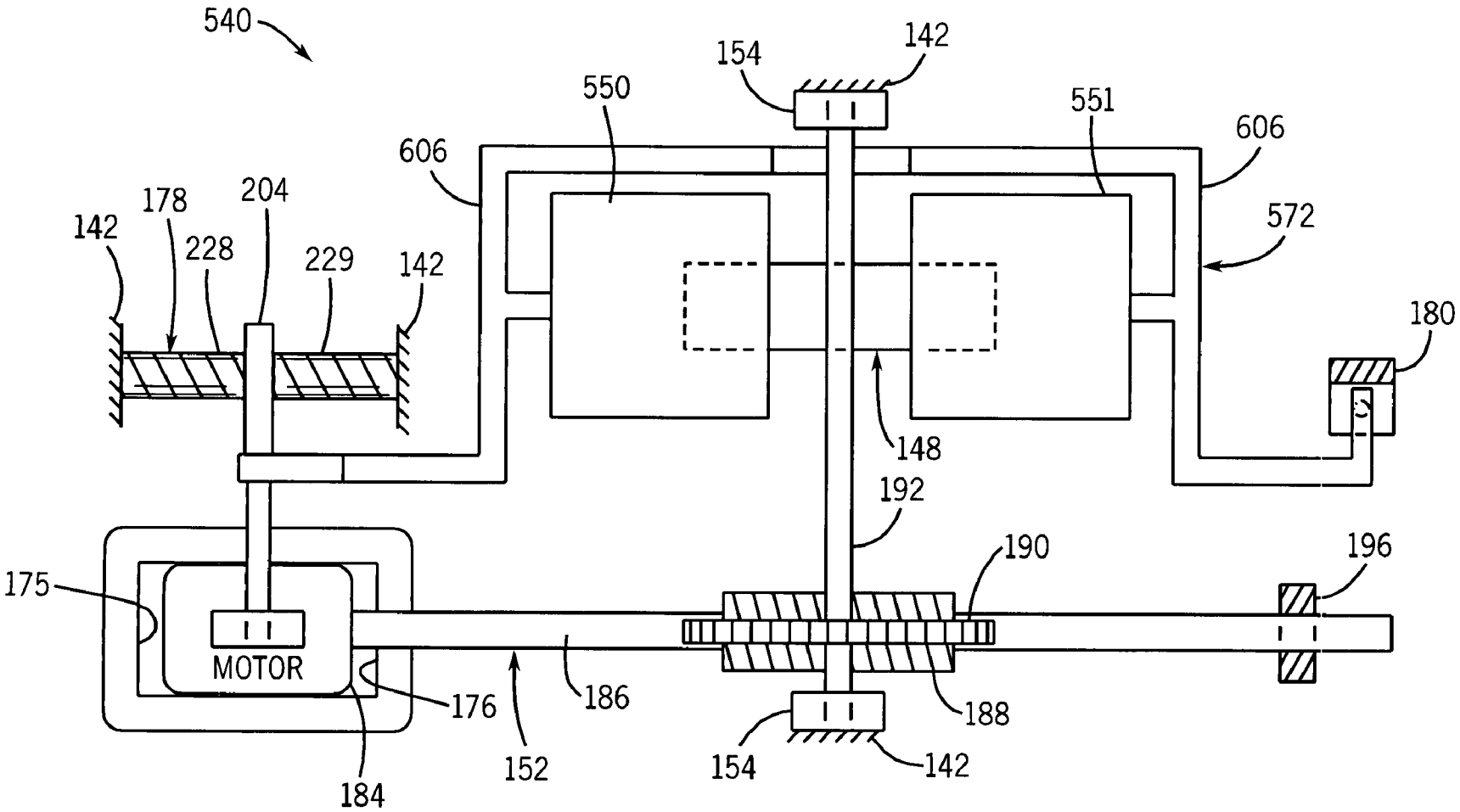
FIG. 11 is a top plan view schematically illustrating the pump of FIG. 10.
Figure 12:
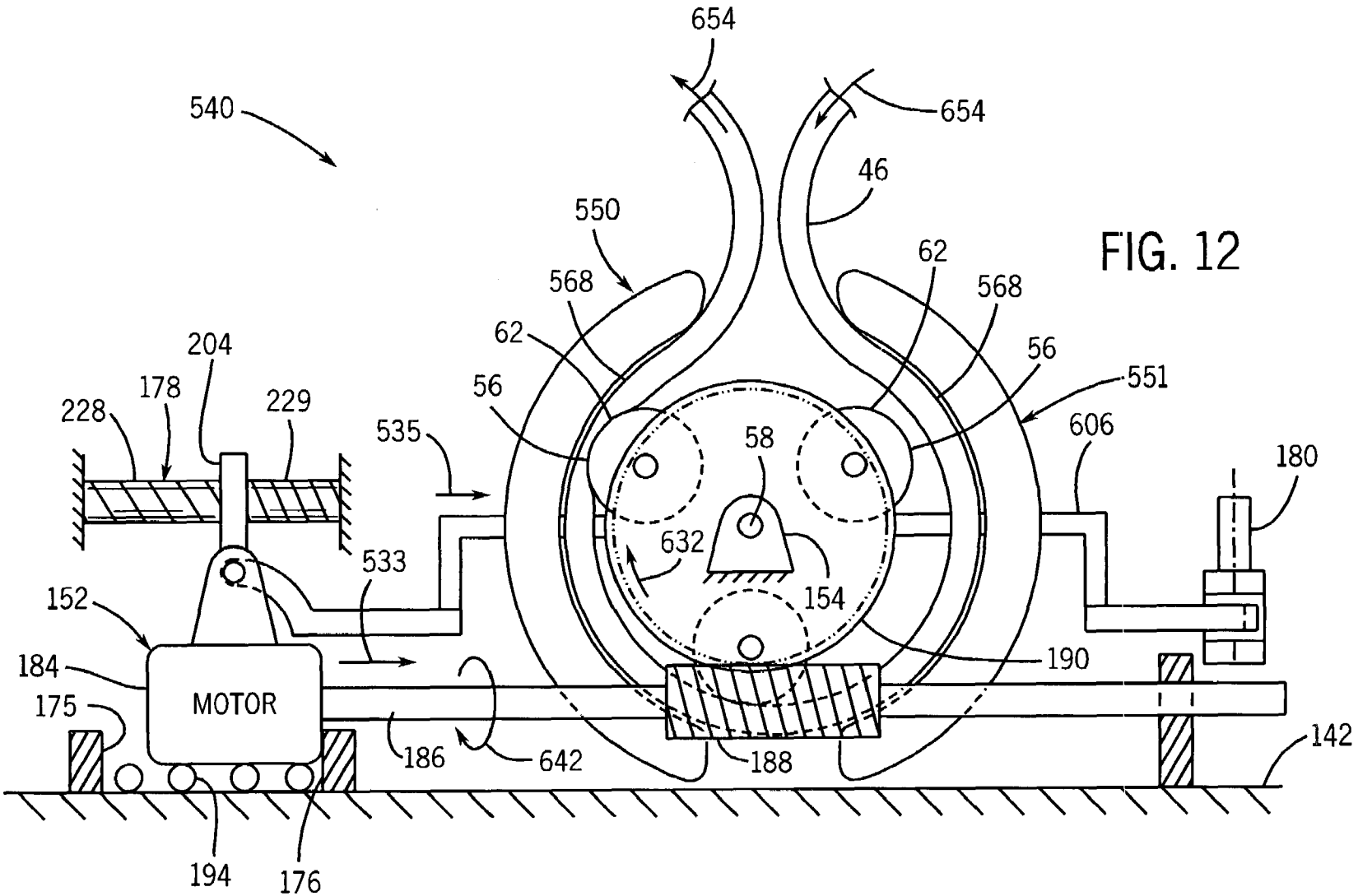
FIG. 12 is a side elevational view schematically illustrating the pump of FIG. 10 in a fluid-pumping state.

FIGS. 10-12 illustrate pump 540, a third alternative embodiment of pump 40 shown in FIG. 2. Pump 540 is similar to pump 140 except that pump 540 includes occlusions 550, 551 in lieu of occlusion 150 and includes coupler 572 in lieu of coupler 172. The remaining components of pump 540 correspond to the elements of pump 140 and are numbered similarly. Occlusions 550 and 551 comprise structures having occluding surfaces 568 facing tubes 46 on an opposite side of tubes 46 as occluding surfaces 56. In the particular embodiment illustrated, occlusion surfaces 568 face one another. In alternative embodiments, occluding surfaces 568 may be slightly offset relative to one another. Occlusions 550 and 551 are configured to alternately cooperate with occluding surfaces 56 to compress tube 46 depending upon the direction in which motor 184 is rotatably driving occluding surfaces 56 about axis 58 and the direction in which fluid is being pumped through tubes 46.

Coupler 572 couples occlusions 550 and 551 to motor 184 such that occlusions 550 and 551 and motor 184 substantially move together along a common axis. In the particular embodiment illustrated, coupler 572 includes leg 606 which is fixedly coupled to both of occlusions 550 and 551 and fixedly coupled to motor mounting portion 304. In alternative embodiments, leg 606 is integrally formed as part of a single unitary body with mounting portion 204 or motor 184.

FIG. 12 illustrates pump 540 pumping fluid through tube 46 in a direction indicated by arrows 654. In particular, FIG. 12 illustrates motor 184 rotatably driving output shaft 186 in a direction indicated by arrow 642 and rotatably driving occluding surfaces 56 about axis 58 in the direction indicated by arrow 632. Interaction between worm 188 and worm gear 190 exerts a force upon motor 184 to move motor 184 in the direction indicated by arrow 533. As a result, motor 184 moves the portion indicated by arrow 533 until engaging limit surface 176. Movement of motor 184 also results in leg 606 being moved in the direction indicated by arrow 535. This results in the occlusion surface 568 of occlusion 550 being moved towards occluding surfaces 56 and axis 58. In addition, occlusion surface 568 of occlusion 551 is moved away from occluding surfaces 56 and away from axis 58.

To pump fluid in the opposite direction, motor 184 rotatably drives output shaft 186 in a direction opposite to that indicated by arrow 642. This results in occlusion 550 being moved away from occluding surfaces 56 and axis 58 while occluding surfaces 568 of occlusion 551 is moved towards occluding surfaces 56 and axis 58 into the pump-compressing state.

When motor 184 stops rotatably driving output shaft 186 such that rotation of occluding surfaces 56 about axis 58 is cessated, springs 228, 229 of bias mechanism 178 engage portion 204 to move motor 184 to a neutral position between limit surfaces 175 and 176 shown in FIG. 10. As a result, both of occlusions 550 and 551 are in the tube uncompressed state which prevents or minimizes formation of a permanent set in tube 46 when pump 540 is not pumping fluid.

Pump 740

Figure 13:
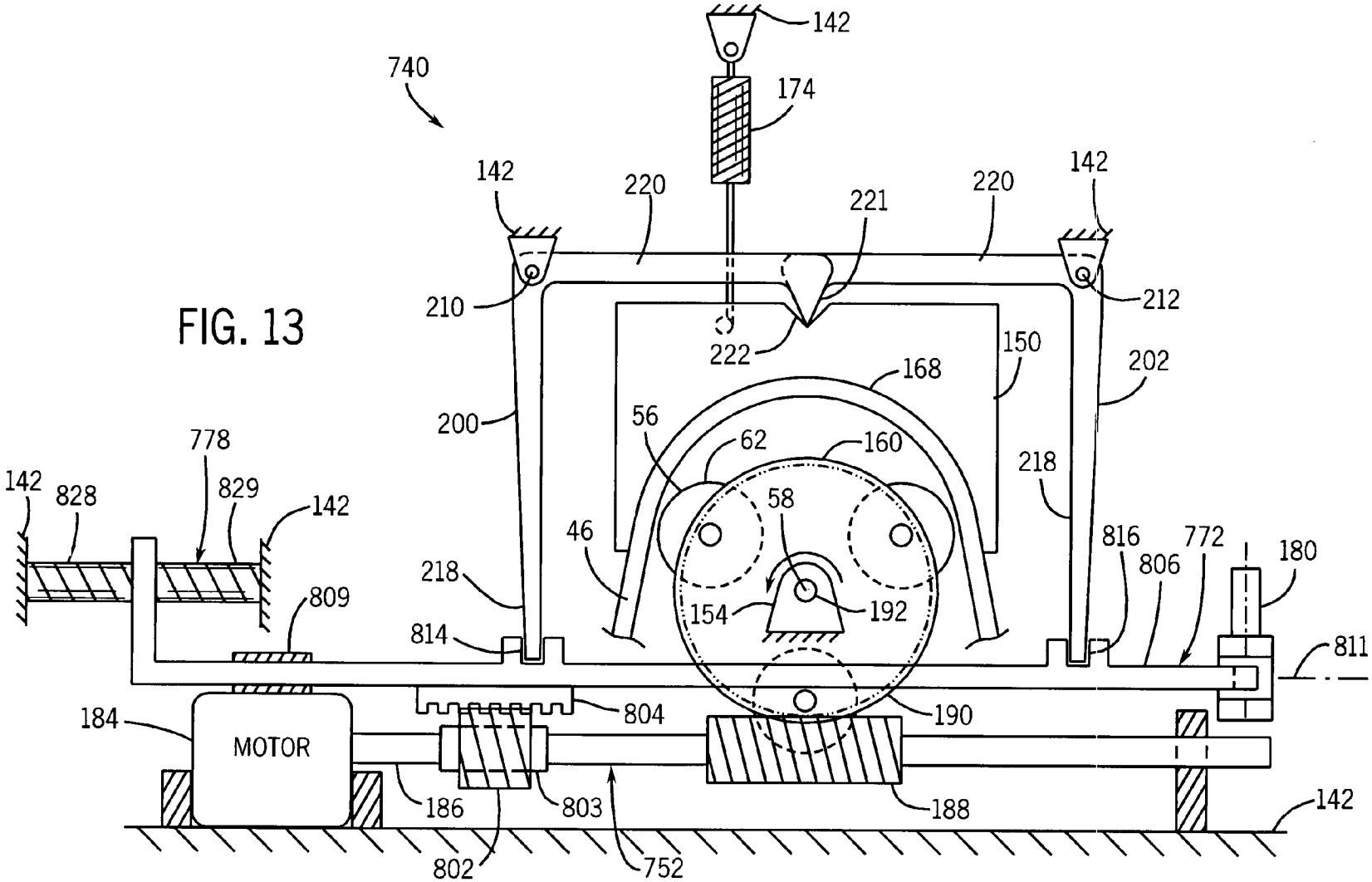
FIG. 13 is a side elevational view schematically illustrating a fourth alternative embodiment of the pump of FIG. 2 in a non-pumping state.

FIG. 13 illustrates pump 740, a fourth alternative embodiment of pump 40. Pump 740 is similar to pump 140 except that pump 740 includes drive system 752 in lieu of drive system 152 and includes coupler 772 in lieu of coupler 172. Drive system 752 is similar to drive system 152 except that motor 184 is stationarily supported relative to base 142. Motor 184 rotatably drives output shaft 186 to rotate worm 188 which is in meshing engagement with worm gear 190. Rotation of worm gear 190 rotates input shaft 192 to rotatably drive roller support 160 and occluding surfaces 56 provided by roller 62 about axis 58. At the same time, rotation of output shaft 186 by motor 184 also moves occlusion 150 between a tube-compressing state and a tube uncompressed state.

Coupler 772 operably couples drive system 752 to occlusion 150. Coupler 772 includes worm 802, slip clutch 803, rack gear 804, leg 806, pivotable arms 200, 202 (described with respect to pump 140). Worm 802 is coupled to output shaft 186 by slip clutch 803 and is in intermeshing engagement with rack gear 804. Rack gear 804 is fixedly coupled to leg 806. Leg 806 is slidably supported by a bushing 809 relative to base 142. Leg 806 is operably coupled to each of arms 200, 202. In the embodiment illustrated, leg 806 includes channels 814 and 816 which receive portions 218 of arms 200 and 202. Movement of leg 806 along axis 811 pivots arms 200 and 202 about axes 210 and 212, respectively. In alternative embodiments, leg 806 may be operably coupled to arms 200 and 202 in other fashions. For example, leg 806 may be operably coupled to arms 200 and 202 by pivot pins extending along axes generally parallel to axis 58 or axes 210, 212.

Bias mechanism 778 resiliently biases leg 806 to a neutral position such that arms 200 and 202 are not pivoted and such that occlusion 150 is biased towards the tube uncompressed state by bias 174. In the particular embodiment illustrated, bias 778 includes compression springs 828, 829 coupled between base 142 and opposite sides of leg 806 along axis 811. In alternative embodiments, bias 778 may comprise other means for resiliently biasing leg 806 towards the neutral position.

During the operation of pump 740, motor 184 rotatably drives output shaft 186 to rotate occluding surfaces 56 about axis 58. At the same time, the rotation of output shaft 186 also rotates worm 802 to move leg 806 along axis 811 until one of springs 828 can no longer be compressed. Springs 828 serve as limit surfaces to limit the extent to which leg 806 may be moved along axis 811. In alternative embodiments, additional or alternative limit surfaces may be provided which directly engage leg 806 to limit movement of leg 806.

When leg 806 has reached a limit position such that leg 806 may no longer be moved in a direction along axis 811, slip clutch 803 releases worm 802 from output shaft 186 in a conventionally known manner such that output shaft 186 may continue to drive occluding surfaces 56 about axis 58 and such that rack gear 804 is maintained relative to worm 802 to maintain leg 806 in the limit position.

When leg 806 is in the limit position, engaging portion 220 of one of arms 200, 202 is withdrawn away from occlusion 150 while engaging portion 220 of the other of arms 200, 202 pivoted into engagement with occlusion 150 so as to move occlusion 150 towards occluding surfaces 56 and into the tube-compressing state in which fluid is pumped through tube 46.

When pump 740 is not being used to pump fluid through tube 46 such that motor 184 is no longer rotatably driving output shaft 186, bias mechanism 778 urges leg 806 towards the neutral position. This results in arms 200, 202 being pivoted to the position shown in FIG. 13 in which engaging portions 220 of both arms 200, 202 are equally withdrawn from occluding surfaces 56. As a result, bias 174 moves occlusion 150 away from occluding surfaces 56 and into the tube uncompressed state to prevent or minimize the formation of a permanent set in tube 46.

Pump 940

Figure 14:
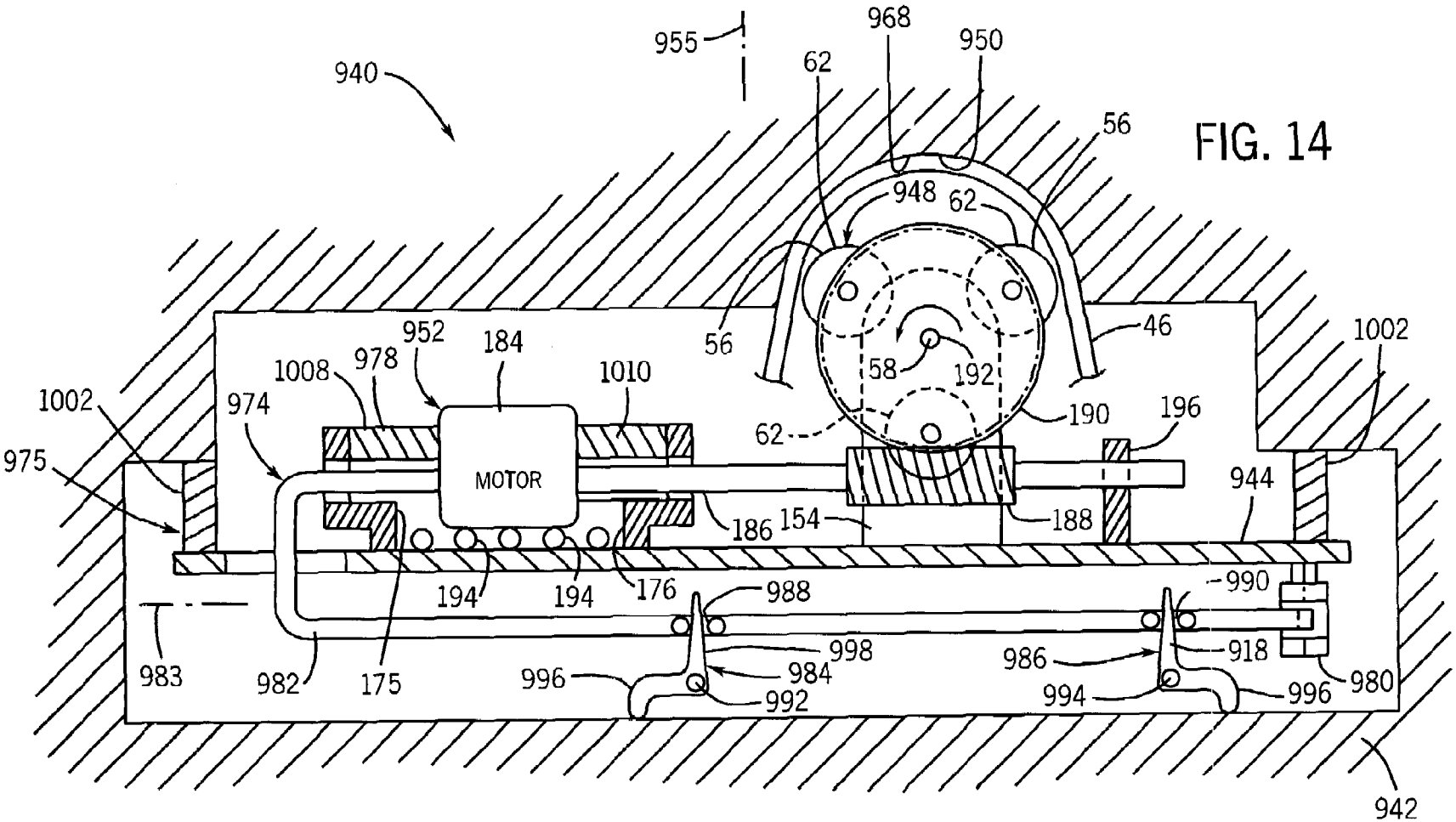
FIG. 14 is a sectional view schematically illustrating a fifth alternative embodiment of the pump of FIG. 2 in a non-pumping state.
Figure 15:
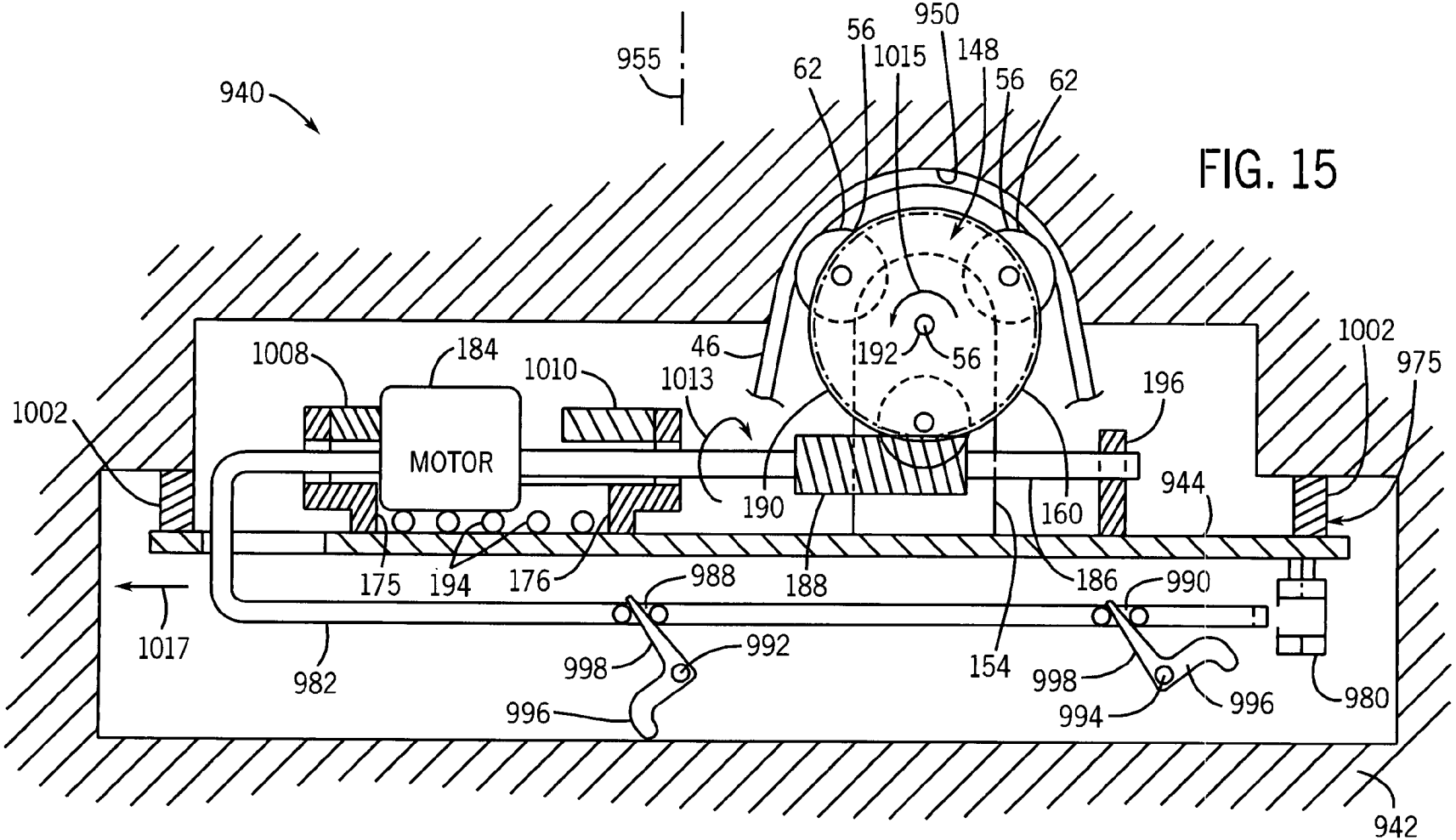
FIG. 15 is a sectional view schematically illustrating the pump of FIG. 14 in a fluid-pumping state.

FIGS. 14 and 15 illustrate pump 940, a fifth alternative embodiment of pump 40. Unlike pumps 140, 340, 540 and 740, pump 940 moves occluding surfaces 56 between the tube-compressing and the tube uncompressed state. Pump 940 includes base 942, platform 946, occluding system 948, occlusion 950, drive system 952, coupler 974 and bias mechanism 975. Base 942 generally comprises one or more structures forming a housing, enclosure, frame or ground for supporting the remaining components of pump 940. Although schematically shown in FIG. 14, base 942 may have a variety of different sizes, shapes and configurations.

Platform 944 generally comprises a structure configured to movably support at least occluding system 948. In the particular embodiment illustrated, platform 944 additionally supports drive system 952. Platform 944 is movably coupled to base 942 so as to move relative to base 942. In one embodiment, platform 944 includes a pair of tongues, while base 942 includes a pair of grooves for guiding movement of platform 944 along axis 955. In other embodiments, platform 944 may be movably supported and guided relative to base 942 by other guide arrangements or other bearings to facilitate sliding movement of platform 944.

Occluding system 948 is similar to occluding system 148 except that support 154 is coupled to platform 944 so as to move with platform 944. Drive system 952 is similar to drive system 152 except that motor 184 is movably supported between limit surfaces 175 and 176 by roller bearings 194 upon platform 944. In alternative embodiments, motor 184 may be movably supported by base 942 in lieu of being movably supported upon platform 944.

Occlusion 950 comprises one or more structures providing occlusion surfaces 968 which extend on an opposite side of tube 46 as compared to occluding surfaces 56. Occlusion surface 968 faces occluding surfaces 56 and cooperates with occluding surfaces 56 in the tube-compressing state such that rotation of surfaces 56 about axis 58 compresses tube 46 to pump fluid through tube 46. Although occlusion 950 is schematically illustrated as being integrally formed as part of a single unitary body with base 942, occlusion 950 may be provided by one or more separate structures which are mounted or otherwise coupled to base 942.

Coupler 974 operably couples drive system 952 to platform 944 to enable drive system 952 to move platform 944 along axis 955. As a result, in addition to rotatably driving occluding surfaces 56 about axis 58, drive system 952 also moves occluding surfaces 56 between the tube-compressing state and the tube uncompressed state. Coupler 974 includes leg 982 and pivotable arms 984, 986. Leg 982 is coupled to drive system 952 such that rotation of output shaft 186 by motor 184 causes linear movement of leg 982 along axis 983. In the particular embodiment illustrated, leg 982 is fixedly coupled to motor 184. In alternative embodiments, leg 982 may include a rack gear in meshing engagement with a worm coupled to output shaft 186 by a slip clutch such that leg 92 moves in a fashion similar to that shown and described with respect to leg 806 in FIG. 13. Leg 982 is operably coupled to arms 984 and 986 by channels 988, 990 which receive portions of arms 984 and 986, respectively.

Arms 984 and 986 are pivotably coupled to base 942 for pivotal movement about axes 992 and 994, respectively. Arms 984 and 986 each include a base-engaging portion 996 and a leg-engaging portion 998. Leg-engaging portions 998 pass through channels 988 and 990, respectively. Base-engaging portions 996 pivot against base 942 during movement of leg 982 along axis 983 to engage leg 982 so as to lift leg 982 along axis 955.

Bias mechanism 975 resiliently biases platform 944 and occluding surfaces 56 towards the tube uncompressed state. In the embodiment illustrated, bias mechanism 975 includes a pair of compression springs 1002 coupled between base 942 and platform 944. Movement of platform 944 towards the tube-compressing state compresses springs 1002. When motor 184 is no longer rotatably driving output shaft 186, springs 1002 urge platform 944 downward along axis 955 until platform 944 comes to rest upon a lower support surface provided by base 942. This downward movement of platform 944 to the tube uncompressed state shown in FIG. 14 also causes motor 184 to be repositioned.

Sensor 180 is coupled to platform 944 and is configured to sense the positioning of platform 944 and occluding surfaces 56. Sensor 980 generates signals indicating such positioning and transmits such signals to controller 32 (shown in FIG. 1). Controller which uses the information received from sensor 180 to control motor 184. In the particular embodiment illustrated, sensor 980 comprises an optical sensor configured and arranged to sense the position of leg 982 which corresponds to the position of platform 944 and occluding surfaces 56 along axis 955.

Bias mechanism 978 resiliently biases drive system 952 to a neutral position between limit surfaces 175, 176. In the particular embodiment illustrated, bias mechanism 978 includes compression springs 1008, 1010 coupled between platform 944 and motor 184. In alternative embodiments, other springs or means may be used for resiliently biasing motor 184 towards a neutral position.

FIG. 15 illustrates pump 940 with occlusion 950 and occluding surfaces 56 in the tube-compressing state such that fluid is being pumped through tubes 46. In particular, FIG. 15 illustrates motor 184 rotatably driving output shaft 186 in the direction indicated by arrow 1013 to rotate roller support 160 and rollers 62 about axis 58 in the direction indicated by arrow 1015. The interaction between worm 188 and worm gear 190 exerts a force upon motor 184 to move motor 184 and lea 982 in the direction indicated by arrow 1017. As a result, leg 982 pivots arms 984 and 986 about axes 992 and 994, respectively. Arm 984 is pivoted against base 942, causing leg 982 to ride upwardly upon arm 984. The upward lifting of leg 982 further lifts platform 944 to move support 154, occluding surfaces 56 and axis 58 upwardly along axis 955 to the tube-compressing state.

The reverse operation of motor 184 rotatably drives output shaft 186 in an opposite direction as shown in FIG. 15 to rotate occluding surfaces 56 about axis 58 in an opposite direction. This also results in fluid being pumped in an opposite direction through tubes 46. During such a reverse operation of motor 184, the interaction of worm 188 and worm gear 190 exerts a force upon motor 184 to urge motor 184 against spring 1010 towards limit surface 176. Movement of leg 982 in the reverse direction as that shown in FIG. 15 results in leg 986 being pivoted against base 942 to lift leg 982, platform 944 and occluding surfaces 56 towards the tube-compressing state.

CONCLUSION

In summary, each of peristaltic pumps 40, 140, 340, 540, 740 and 940 increase the life of pumping tube 46 while facilitating more consistent and reliable pumping of fluid by automatically moving the occlusion surface and the occluding surfaces away from one another when the pump is not in use to prevent the formation of permanent sets in tube 46. Each of pumps 40, 140, 340, 540, 740 and 940 automatically moves the occlusion surfaces and the occluding surfaces towards one another to the tube-compressing state irregardless of the direction in which fluid is being pumped through tube 46. Because each of pumps 40, 140, 340, 540, 740 and 940 utilizes a single drive system to rotate occluding surfaces about axis 58 and to also move at least one of the occlusion surface and the occluding surfaces between the tube-compressing state and the tube uncompressed state, the size and manufacturing cost of the pumps is greatly reduced.

Although each of pumps 140, 340, 540, 740 and 940 has been illustrated for pumping fluid through a single tube 46, such pumps may alternatively be modified to pump fluid through the plurality of tubes 46 by increasing the axial length of the occlusion and the occluding system. Although each of pumps 40, 140, 340, 540, 740 and 940 has been illustrated and described for pumping ink in a printing system, each of such pumps may alternatively be utilized to pump other fluids in other applications such as medical applications and the like.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements. Furthermore, those dependent claims that do not have limitations phrased in the "means or step for performing a specified function" format permitted by 35 U.S.C. §112, ¶6 are not to be interpreted under §112, ¶6 as being limited solely to the structure, material or acts described in the present application and their equivalents.

What is claimed is:

1. A peristaltic pump comprising:

occluding surfaces rotatably supported about a common axis by a support;

a first occlusion having a first occlusion surface, wherein one of the support and the first occlusion is movable towards the other of the support and the first occlusion; and a drive system configured to rotate the occluding surfaces and coupled to said one of the support and the first occlusion so as to move said one of the support and the first occlusion; and at least one bias mechanism coupled to said one of the support and the first occlusion to resiliently bias said one of the support and the first occlusion towards a non-pumping position the at least one bias mechanism being out of contact with the first occlusion surface.

2. The pump of claim 1, wherein the drive system is coupled to the first occlusion to move the first occlusion surface relative to the occluding surfaces.

3. The pump of claim 2 including a first pivotable arm having a first portion coupled to the drive system and a second portion operably coupled to the occlusion surface.

4. The pump of claim 3 including a second pivotable arm having a first portion coupled to the drive system and a second portion operably coupled to the first occlusion.

5. The pump of claim 1, wherein the first occlusion is resiliently biased towards the non-pumping position by the at least one bias mechanism.

6. The pump of claim 1, wherein the drive system is coupled to the support to move the support relative to the first occlusion.

7. The pump of claim 6 including a platform supporting the drive system and the support, wherein the platform is movably supported relative to the first occlusion and wherein the drive system is operably coupled to the platform so as to move the platform.

8. The pump of claim 7, wherein the drive system includes:

a motor having an output shaft, wherein the motor is movably supported relative to the platform; and a drive train coupled between the output shaft and the occluding surface, wherein the motor is operably linked to the platform and wherein movement of the motor moves the platform and the support.

9. The pump of claim 8, wherein the motor is resiliently biased towards a pre-selected position.

10. The pump of claim 9, wherein the motor is resiliently biased towards the position such that the occlusion surface is spaced from the occluding surfaces by a distance greater than the diameter of the pumping tube.

11. The pump of claim 8 including a first stop surface configured to limit travel of the motor in a first direction.

12. The pump of claim 11 including a second stop surface configured to limit travel of the motor in a second opposite direction.

13. The pump of claim 8, wherein the drive train includes:
a worm gear; and
a worm in engagement with the worm gear.

14. The pump of claim 8 including a first pivotable arm having a first portion operably linked to the motor and a second portion, wherein movement of the motor in a first direction pivots the second portion into engagement with the platform.

15. The pump of claim 14 including a second pivotable arm having a third portion operably linked to the motor and a fourth portion, wherein movement of the motor in a second opposite direction pivots the fourth portion into engagement with the platform.

16. The pump of claim 1, wherein the drive system is configured to move said one of the support and the first occlusion from a non-pumping position towards a pumping position when the occluding surfaces are rotated about the common axis in a first direction and wherein the drive system is configured to move said one of the support and the first occlusion from the non-pumping position to the pumping position during rotation of the occluding surfaces about the common axis in a second opposite direction.

17. A peristaltic pump comprising:
a fluid passage having a compressible portion;
occluding surfaces rotatably supported about a common axis by a support on a first side of the compressible portion of the fluid passage;
an occlusion surface on a second opposite side of the compressible portion of the fluid passage;
a rotary actuator; and
means for operably connecting the rotary actuator to one of the support and the occlusion surface such that the rotary actuator simultaneously rotates the occluding surfaces and moves said one of the support and the occlusion surface towards and away from the other of the support and the occlusion surface between a tube compressing state and a tube uncompressed state; and
means for operably linking the rotary actuator to said one of the occluding surfaces and the occlusion surface such that rotation of the occluding surfaces in a first direction simultaneously moves said one of the support and the occlusion surface towards a tube compressing state and such that rotation of the occluding surfaces in a second opposite direction simultaneously moves said one of the support and the occlusion surface towards the tube compressing state.

18. A method for pumping fluid through a tube, the method comprising:
generating a torque;
transmitting the torque to occluding surfaces to rotate the occluding surfaces relative to a support about a common axis;
transmitting the torque to one of the support and an occlusion surface to move at least one of the support and the occlusion surface towards and away from the other of the support and the occlusion surface between a tube compressing state in which the tube is compressed between the occluding surfaces and the occlusion surface and a tube uncompressed state; and
resiliently biasing said one of the support and the occlusion surface such that the support is spaced from the occlusion surface by a distance greater than the diameter of the pumping tube.

19. The method of claim 18 further comprising converting the torque to a linear force to move said one of the support and the occlusion surface relative to the other of the support and the occlusion surface between the tube compressing state in which the tube is compressed between the occluding surfaces and the occlusion surface and the tube uncompressed state.

20. A peristaltic pump comprising:
occluding surfaces;
an occlusion facing the occluding surfaces; and
a drive system configured to rotate the occluding surfaces in a first direction so as to move one of the occluding surfaces and the occlusion from a non-pumping position towards a pumping position and configured to rotate the occluding surfaces in a second opposite direction so as to move said one of the occluding surfaces and the occlusion from the non-pumping position towards the pumping position.

21. An apparatus comprising:
a peristaltic pump comprising:
occluding surfaces rotatably supported about a common axis by a support;
a first occlusion having a first occlusion surface, wherein the first occlusion is movable towards the support; and
a drive system configured to rotate the occluding surfaces and coupled to the first occlusion so as to move the first occlusion relative to the occluding surfaces, wherein the drive system includes:
a motor having an output shaft, wherein the motor is movably supported; and
a drive train coupled between the output shaft and the occluding surfaces, wherein the motor is operably Linked to the first occlusion and wherein movement of the motor moves the first occlusion relative to the occluding surfaces.

22. The apparatus of claim 21, wherein the motor is linearly movable.

23. The apparatus of claim 21, wherein the motor pivots.

24. The apparatus of claim 21, wherein the motor is resiliently biased towards a pre-selected position.

25. The apparatus of claim 24 further comprising a pumping tube, wherein the motor is resiliently biased towards the position such that the first occlusion surface is spaced from the occluding surfaces by a distance greater than the diameter of the pumping tube.

26. The apparatus of claim 21 including at least one bias mechanism coupled to the motor to resiliently bias the motor towards a preselected position.

27. The apparatus of claim 21 including a first stop surface configured to limit travel of the motor in a first direction.

28. The apparatus of claim 27 including a second stop surface configured to limit travel of the motor in a second opposite direction.

29. The apparatus of claim 21, wherein the drive train includes:
a worm gear; and
a worm in engagement with the worm gear.

30. The apparatus of claim 21, wherein the drive train includes:
a first spur gear; and
a second spur gear in engagement with the first spur gear, wherein the pump further includes a linkage pivotably supporting the motor relative to the first spur gear.

31. The apparatus of claim 21 including a first pivotable arm having a first portion operably linked to the motor and a second portion, wherein movement of the motor in a first direction pivots the second portion into engagement with the first occlusion.

32. The apparatus of claim 31 including a second pivotable arm having a third portion operably linked to the motor and a fourth portion, wherein movement of the motor in a second opposite direction pivots the fourth portion into engagement with the first occlusion.

33. The apparatus of claim 21, wherein the motor is stationarily coupled to the first occlusion such that the motor and the first occlusion move together.

34. The apparatus of claim 33 including a second occlusion having a second occlusion surface, wherein the second occlusion is stationarily coupled to the motor such that the motor and the second occlusion move together.

35. The apparatus of claim 34, wherein the first occlusion surface and the second occlusion surface face one another.

36. The apparatus of claim 21 further comprising:

an ink reservoir;

an ink dispensing device configured to dispense ink upon a medium; and a pumping tube in fluid communication with the ink reservoir and the ink dispensing device and positioned between the occluding surfaces and the occlusion.

37. The apparatus of claim 21 further comprising at least one bias mechanism coupled to said one of the support and the first occlusion to resiliently bias said one of the support and the first occlusion towards a non-pumping position.

38. A peristaltic pump comprising:

occluding surfaces rotatably supported about a first common axis by a support;

a first occlusion having a first occlusion surface, wherein the first occlusion is movable towards the support;

a drive system configured to rotate the occluding surfaces and coupled to the occlusion so as to move the occlusion relative to the occluding surfaces;

a first pivotable arm pivotable about a second axis and having a first portion coupled to the drive system and a second portion operably coupled to the occlusion surface; and a second pivotable arm pivotable about a third axis and having a first portion coupled to the drive system and a second portion operably coupled to the first occlusion.

39. The pump of claim 1 further comprising at least one tube between the occluding surfaces and the first occlusion surface.

* * * * *

UNITED STATES PATENT AND TRADEMARK OFFICE

CERTIFICATE OF CORRECTION

PATENT NO. : 7,300,264 B2
APPLICATION NO. : 10/657425
DATED : November 27, 2007
INVENTOR(S) : Timothy M. Souza It is certified that error appears in the above-identified patent and that said Letters Patent is hereby corrected as shown below:

In column 9, line 23, delete “15” and insert -- 152 --, therefor.

In column 15, line 7, delete “lea” and insert -- leg --, therefor.

In column 18, line 29, in Claim 21, delete “Linked” and insert -- linked --, therefor.

Signed and Sealed this

Fifth Day of August, 2008

JON W. DUDAS
*Director of the United States Patent and Trademark Office*